US011454919B2

(12) United States Patent
Sato et al.

(10) Patent No.: US 11,454,919 B2
(45) Date of Patent: Sep. 27, 2022

(54) IMAGE FORMING APPARATUS INCLUDING PROCESS CARTRIDGE HAVING A TONER CARTRIDGE DETACHABLY ATTACHED TO A DRUM CARTRIDGE

(71) Applicant: BROTHER KOGYO KABUSHIKI KAISHA, Nagoya (JP)

(72) Inventors: Shougo Sato, Seto (JP); Yasuo Fukamachi, Aichi (JP); Motoaki Mushika, Hashima (JP); Kazuna Taguchi, Aichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/321,751

(22) Filed: May 17, 2021

(65) Prior Publication Data

US 2021/0271198 A1 Sep. 2, 2021

Related U.S. Application Data

(63) Continuation of application No. 16/855,030, filed on Apr. 22, 2020, now Pat. No. 11,009,826, which is a (Continued)

(30) Foreign Application Priority Data

Dec. 7, 2015 (JP) ..... 2015-238811

(51) Int. Cl.
*G03G 21/16* (2006.01)
*G03G 21/18* (2006.01)

(52) U.S. Cl.
CPC ..... *G03G 21/1633* (2013.01); *G03G 21/1647* (2013.01); *G03G 21/1676* (2013.01); *G03G 21/1814* (2013.01); *G03G 21/1821* (2013.01)

(58) Field of Classification Search
CPC ..... G03G 21/1633; G03G 21/1647; G03G 21/1676; G03G 21/1814; G03G 21/1821; G03G 21/1842
See application file for complete search history.

(56) References Cited

U.S. PATENT DOCUMENTS 3,010,014 A1 8/2011 Noguchi
2003/0053819 A1 3/2003 Nomura et al.
(Continued)

FOREIGN PATENT DOCUMENTS

JP 11-174933 A 7/1999
JP 2005-134483 A 5/2005
(Continued)

OTHER PUBLICATIONS

Related U.S. Appl. No. 15/364,996, filed Nov. 30, 2016.
(Continued)

*Primary Examiner* — Sophia S Chen
(74) *Attorney, Agent, or Firm* — Merchant & Gould P.C.

(57) ABSTRACT

An image forming apparatus, including a process cartridge and a main body with an opening and a cover, is provided. The process cartridge includes a drum cartridge, a toner cartridge, and a switching member. The switching member switches states in the process cartridge between a first state, wherein the toner cartridge is restricted from being detached, and a second state, wherein the toner cartridge is released from the restriction. The process cartridge is movable between an attached position to be placed entirely inside the main body and a detached position to be entirely outside the main body. The main body includes a restrictor to restrict the process cartridge from moving from an intermediate position toward the detached position. While the process cartridge is restricted by the restrictor, a supportive part in the
(Continued)

cover supports the process cartridge with the switching member being at least partly placed outside the main body.

14 Claims, 12 Drawing Sheets

Related U.S. Application Data continuation of application No. 16/382,442, filed on Apr. 12, 2019, now Pat. No. 10,866,556, which is a continuation of application No. 16/137,158, filed on Sep. 20, 2018, now Pat. No. 10,303,110, which is a continuation of application No. 15/370,809, filed on Dec. 6, 2016, now Pat. No. 10,108,138.

(56) References Cited

U.S. PATENT DOCUMENTS

| | | | |
|---|---|---|---|
| 2005/0191090 | A1 | 9/2005 | Nishimura |
| 2006/0067734 | A1 | 3/2006 | Igarashi et al. |
| 2006/0251446 | A1 | 11/2006 | Okabe et al. |
| 2009/0180802 | A1 | 7/2009 | Sato et al. |
| 2010/0080617 | A1 | 4/2010 | Noguchi |
| 2011/0064463 | A1 | 3/2011 | Hashimoto et al. |
| 2011/0182612 | A1 | 7/2011 | Kamimura et al. |
| 2011/0217075 | A1 | 9/2011 | Uehara et al. |
| 2011/0236055 | A1 | 9/2011 | Mori et al. |
| 2011/0311269 | A1 | 12/2011 | Murooka |
| 2013/0016995 | A1 | 1/2013 | Hiramatsu et al. |
| 2013/0051851 | A1 | 2/2013 | Fukamachi |
| 2015/0050042 | A1 | 2/2015 | Sato et al. |
| 2015/0050059 | A1 | 2/2015 | Sato et al. |
| 2015/0261173 | A1 | 9/2015 | Sato |
| 2015/0261179 | A1 | 9/2015 | Sato et al. |
| 2015/0277368 | A1 | 10/2015 | Nishiyama |
| 2016/0041519 | A1 | 2/2016 | Sato |
| 2017/0031275 | A1* | 2/2017 | Ohkubo ..... G03G 21/185 |
| 2017/0153597 | A1 | 6/2017 | Sato |
| 2017/0219995 | A1 | 8/2017 | Sato et al. |

FOREIGN PATENT DOCUMENTS

| | | | |
|---|---|---|---|
| JP | 2006-58350 | A | 3/2006 |
| JP | 2010-102321 | A | 5/2010 |
| JP | 2013-20112 | A | 1/2013 |

OTHER PUBLICATIONS

U.S. Office Action issued in related U.S. Appl. No. 15/364,996, dated Nov. 30, 2017.

U.S. Office Action issued in related U.S. Appl. No. 15/364,996, dated Mar. 26, 2018.

Office Action issued in related U.S. Appl. No. 16/014,538, dated Jan. 11, 2019.

Office Action issued in related U.S. Appl. No. 16/014,538, dated Jun. 19, 2019.

Non-Final Office Action issued in related U.S. Appl. No. 16/773,296, dated Mar. 27, 2020.

Office Action (Notice of Reasons for Refusal) issued in corresponding Japanese Patent Application No. 2019-224042, dated Dec. 1, 2020.

* cited by examiner

IMAGE FORMING APPARATUS INCLUDING PROCESS CARTRIDGE HAVING A TONER CARTRIDGE DETACHABLY ATTACHED TO A DRUM CARTRIDGE

CROSS-REFERENCE TO RELATED APPLICATION

This application is a Continuation of U.S. patent application Ser. No. 16/855,030, filed Apr. 22, 2020, and which issued as U.S. Pat. No. 11,009,826, on May 18, 2021, which is a Continuation of U.S. patent application Ser. No. 16/382,442, filed Apr. 12, 2019, and which issued as U.S. Pat. No. 10,866,556 on Dec. 15, 2020, which is a Continuation of U.S. patent application Ser. No. 16/137,158, filed Sep. 20, 2018, and which issued as U.S. Pat. No. 10,303,110 on May 28, 2019, which is a continuation of U.S. patent application Ser. No. 15/370,809, filed on Dec. 6, 2016, and which issued as U.S. Pat. No. 10,108,138 on Oct. 23, 2018, which claims priority under 35 U. S. C. § 119 from Japanese Patent Application No. 2015-238811, filed on Dec. 7, 2015. The entire subject matter of the previously filed applications are incorporated herein by reference.

BACKGROUND OF THE INVENTION

Technical Field

The following description is related to an aspect of an image forming apparatus capable of forming images in an electro-photographic style.

Related Art

An image forming apparatus, having a process cartridge that contains toner therein and includes a photosensitive drum and a developer sleeve, for forming images in an electro-photographic style is known.

For example, an image forming apparatus with a door for a toner cartridge, which is openable for maintenance operations including replacement of process cartridges and removal of a jammed sheet, is known. The door may have a cartridge-door guide, on which the process cartridge to be replaced may be supported transiently or temporarily.

BRIEF SUMMARY OF THE INVENTION

While the process cartridge may be placed temporarily on the cartridge-door guide, without being fastened, the process cartridge may fall rather easily from the cartridge-door guide by, for example, a small accidental impact or vibration.

Meanwhile, the image forming apparatus may employ a process cartridge including a drum cartridge and a toner cartridge, which are separable from one another.

When an image forming apparatus employs such a process cartridge with the separable drum cartridge and toner cartridge, the toner cartridge may be detached from or attached to the drum cartridge for replacement while the process cartridge is placed transiently on the cartridge guide.

In this regard, there may be a demand that the toner cartridges may be replaced smoothly while the process cartridge is supported on the cartridge guide.

The present disclosure is advantageous in that an image forming apparatus, in which a toner cartridge is detachable from and attached to a drum cartridge for replacement while the process cartridge is maintained supported stably by a supportable structure of a cover, is provided.

According to an aspect of the present disclosure, an image forming apparatus, having a process cartridge and a main body having an opening, is provided. The main body includes a cover movable between a closing position, in which the cover closes the opening, and an open position, in which the opening is exposed. The cover includes a supportive part configured to support the process cartridge when in the open position. The process cartridge includes a drum cartridge having a photosensitive drum; a toner cartridge configured to be detachably attached to the drum cartridge; and a switching member configured to switch states in the process cartridge, while the toner cartridge is attached to the drum cartridge, between a first state, in which the toner cartridge is restricted from being detached from the drum cartridge, and a second state, in which the toner cartridge is released to be detachable from the drum cartridge. The process cartridge is movable between an attached position, in which the process cartridge is entirely placed in an inner space formed inside the main body on an inner side with respect to the opening, and a detached position, in which the process cartridge is entirely placed outside the inner space on an outer side with respect to the opening. The main body includes a restrictor configured to restrict the process cartridge from moving from an intermediate position between the attached position and the detached position toward the detached position with at least a part of the process cartridge being placed outside the inner space formed inside the main body. While the process cartridge is restricted by the restrictor from moving, the supportive part supports the process cartridge, and at least a part of the switching member is placed outside the inner space of the main body.

According to another aspect of the present disclosure, an image forming apparatus, having a process cartridge and a main body is provided. The process cartridge has a drum cartridge including a photosensitive drum; a toner cartridge detachably attachable to the drum cartridge; and an operable lever provided on one of the drum cartridge and the toner cartridge. The operable lever is movable between a first state, in which the toner cartridge is restricted from being detached from the drum cartridge, and a second state, in which the toner cartridge is released to be detachable from the drum cartridge. The main body has an opening and a cartridge accommodating portion, to which the process cartridge is detachably attachable through the opening. The process cartridge is movable with respect to the main body between an attached position, in which the process cartridge is entirely placed in an inner space formed inside the main body on an inner side with respect to the opening, and a detached position, in which the process cartridge is entirely placed outside the inner space on an outer side with respect to the opening. The main body includes a cover movable between a closing position, in which the cover closes the opening, and an open position, in which the opening is exposed, the cover supporting the process cartridge when in the open position; a groove to which a drum shaft of the photosensitive drum is inserted; and a spring arranged in the groove. While the drum shaft contacts the spring, the cover supports the process cartridge, and at least a part of the operable lever is placed outside the inner space of the main body.

EMBODIMENTS

Figure 1:
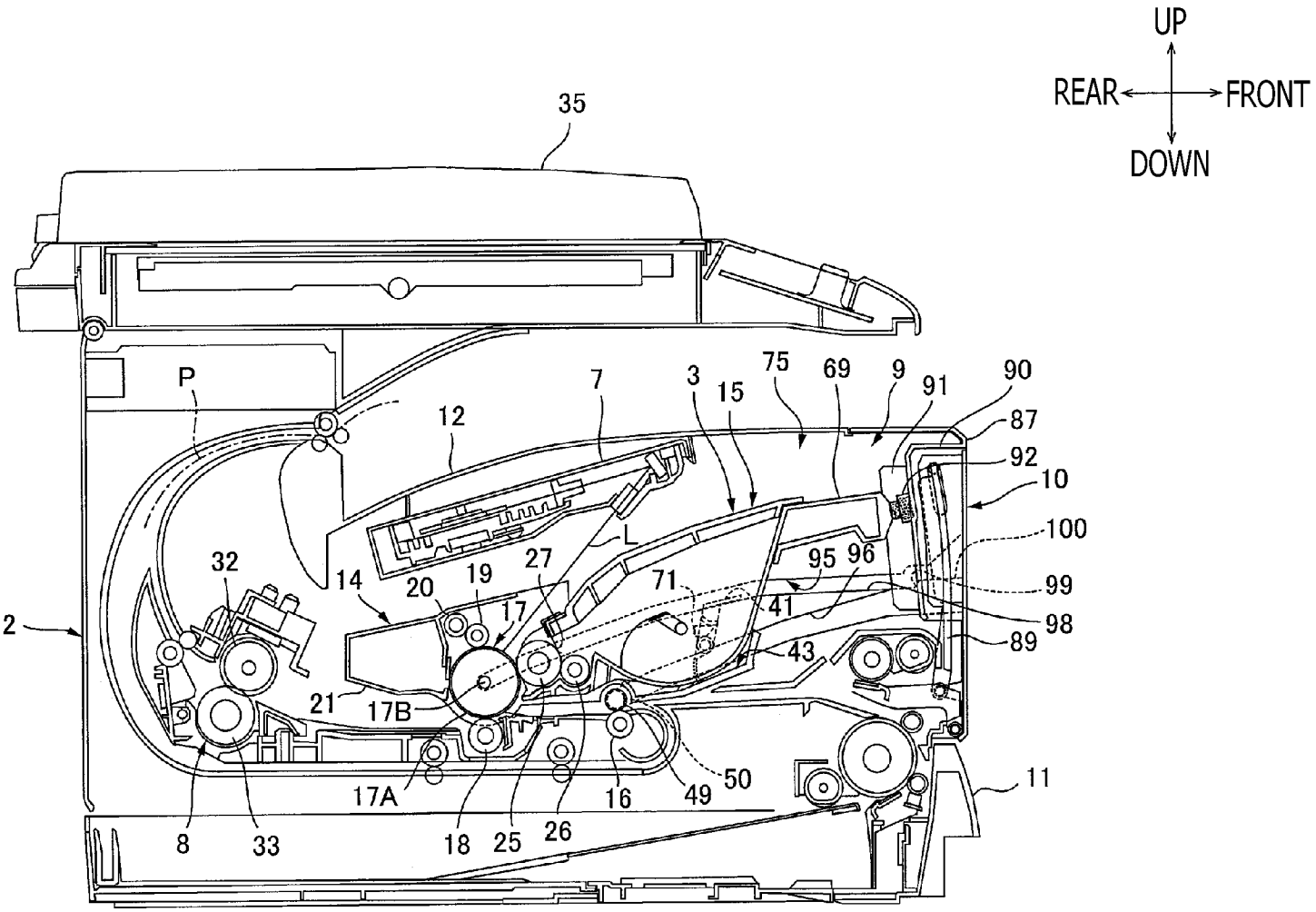
FIG. 1 is a cross-sectional view of an image forming apparatus according to a first exemplary embodiment of the present disclosure.

Hereinafter, an image forming apparatus 1 according to exemplary embodiments of the present disclosure will be described with reference to the accompanying drawings. In the following description, directions related to the image forming apparatus 1 will be cited with reference to arrows shown in the drawings. For example, in FIG. 1, a viewer's upward, downward, rightward, and leftward directions will be referred to as upward, downward, frontward, and rearward directions in the image forming apparatus 1, respectively. An up-to-down or down-to-up direction may be referred to as a vertical direction, and a front-to-rear or rear-to-front direction may be referred to as a front-rear direction. Further, a left-to-right or right-to-left direction may be referred to as a widthwise direction.

1. Overall Configuration of the Image Forming Apparatus

The image forming apparatus 1 shown in FIG. 1 is a monochrome printer for forming images in an electrophotographic style. The image forming apparatus 1 includes a main body 2 formed to have an opening 9, a process cartridge 3, a scanner unit 7, a first conveyer roller 16, a transfer roller 18, a fuser unit 8, and a reader unit 35.

The main body 2 is formed in an approximate shape of a box and includes a cover 10, a sheet-feeder tray 11, and a sheet-ejection tray 12.

The opening 9 is formed in a frontend part of the main body 2 to allow communication between inside and outside of the main body 2. The opening 9 is in a form to allow the process cartridge 3 to pass there-through.

The cover 10 is located in a frontend area of the main body 2. The cover 10 is formed to have an approximate shape of a plate and may be arranged to spread vertically. The cover 10 is swingably supported at a lower end thereof by the frontend part of the main body 2. The cover 10 is swingably movable between a closing position (FIG. 1) to close the opening 9 and an open position (see FIG. 5) to expose the opening 9.

The sheet-feeder tray 11 is located in a lower end area of the main body 2. The sheet-feeder tray 11 may store one or more sheets P therein.

The sheet-ejection tray 12 is located in an approximately central area with regard to the front-rear direction in an upper area of the main body 2. The sheet-ejection tray 12 is formed on an upper surface of the main body 2 to deepen downward so that the ejected sheets P may be placed thereon.

The process cartridge 3 is detachably attachable to the main body 2. The process cartridge 3 is located in an approximately vertically central area in the main body 2. The process cartridge 3 is located at an upper position with respect to the sheet-feeder tray 11 and at a lower position with respect to the sheet-ejection tray 12. The process cartridge 3 includes a drum cartridge 14 and a toner cartridge 15.

The drum cartridge 14 includes a photosensitive drum 17, a charger roller 19, a charger-cleaning roller 20, and a drum-cleaning unit 21. The charger roller 19 may charge a surface of the photosensitive drum 17. The charger-cleaning roller 20 may remove waste materials such as residual toner and/or paper dust adhered to the surface of the charger roller 19. The drum-cleaning unit 21 may collect and store waste materials adhered to the photosensitive drum 17.

The photosensitive drum 17 is located in a rear end area in the drum cartridge 14. The photosensitive drum 17 is formed to have an approximate shape of a cylinder axially extending in the widthwise direction.

The toner cartridge 15 is detachably attachable to the drum cartridge 14. The toner cartridge 15 is located frontward with respect to the photosensitive drum 17. The toner cartridge 15 may store toner therein. The toner cartridge 15 includes a developer roller 25, a supplier roller 26, and a spreader blade 27.

The developer roller 25 is located in a rear end area in the toner cartridge 15. The developer roller 25 is arranged to contact the surface of the photosensitive drum 17 and is rotatable.

The supplier roller 26 is located frontward with respect to the developer roller 25. The supplier roller 26 is arranged to contact the surface of the photosensitive drum 17 and is rotatable.

The spreader blade 27 is located frontward with respect to the developer roller 25. The spreader blade 27 is in an arrangement such that a lower end thereof is located at an upper position with respect to the supplier roller 26 and contacts a surface of the developer roller 25.

The scanner unit 7 is located at an upper position with respect to the process cartridge 3. The scanner unit 7 may emit a laser beam L at the photosensitive drum 17 based on image data.

The first conveyer roller 16 is located at an upper position with respect to the sheet-feeder tray 11.

The transfer roller 18 is located at a rearward position with respect to the first conveyer roller 16 and at a lower position with respect to the photosensitive drum 17. The transfer roller 18 is arranged to contact the photosensitive drum 17.

The fuser unit 8 is located rearward with respect to the process cartridge 3. The fuser unit 8 includes a heat roller 32 and a pressure roller 33 arranged to contact the heat roller 32.

The reader unit 35 is located at an upper position with respect to the main body 2. The reader unit 35 is arranged at an upper and spaced-apart position from the sheet-ejection tray 12. The reader unit 35 may be a flatbed-typed image scanner. The reader unit 35 may read imaging information concerning an original document.

The image forming apparatus 1 may start an image forming action under control of a controller, which is not shown. As the image forming action starts, the charger roller 19 electrically charges the surface of the photosensitive drum 17 evenly. Meanwhile, the scanner unit 7 emits the laser beam L at the photosensitive drum 17 to expose the surface of the photosensitive drum 17 selectively based on the image data. Thereby, an electrostatic latent image based on the image data is formed on the surface of the photosensitive drum 17.

The supplier roller 26 supplies the toner in the toner cartridge 15 to the developer roller 25. The toner to be supplied to the developer roller 25 is positively charged by friction between the developer roller 25 and the supplier roller 26. The developer roller 25 carries the positively charged toner on the surface thereof. The spreader blade 27 spreads the toner carried on the surface of the developer roller 25 to flatten the toner evenly and restrict thickness of the toner on the surface of the developer roller 25.

The toner carried on the developer roller 25 is supplied to the electrostatic latent image on the surface of the photosensitive drum 17. Thus, a toner image is formed and carried on the surface of the photosensitive drum 17.

Meanwhile, the sheets P are conveyed from the sheet-feeder tray 11 one-by-one at predetermined timings by rotations of the first conveyer roller 16 and a second conveyer roller 49, which will be described later, to be fed to a position between the photosensitive drum 17 and the transfer roller 18. The toner image formed on the surface of the photosensitive drum 17 is transferred to the sheet P as the sheet P passes through the position between the photosensitive drum 17 and the transfer roller 18.

Thereafter, the sheet P is conveyed to pass through a position between the heat roller 32 and the pressure roller 33 so that the sheet P is heated and pressed by the heat roller 32 and the pressure roller 33. Thus, the toner image on the sheet P is fused and thermally fixed thereon.

The sheet P is thereafter ejected at the sheet-ejection tray 12.

2. Process Cartridge

The process cartridge 3 is movable between a first position (see FIG. 1), in which the process cartridge 3 is entirely accommodated in an inner space formed inside the main body 2, and a second position (see FIG. 5), in which a front end of the process cartridge 3 projects frontward to be exposed through the opening 9. The process cartridge 3 may be pulled further frontward by a user to be drawn out of the main body 2 and removed entirely to be detached from the main body 2 (see, for example, FIG. 6).

The inner space in the main body 2 is a room, in which the process cartridge 3 may be loaded. Specifically, the inner space in the main body 2 may be a room between the scanner unit 7 and the transfer roller 18 with regard to the vertical direction and between the fuser unit 8 and the cover 10 being in the closing position with regard to the front-rear direction.

The following description concerning the process cartridge 3 is, unless otherwise noted, based on a basic condition of the process cartridge 3 being in the first position.

2-1. Drum Cartridge

Figure 2A:
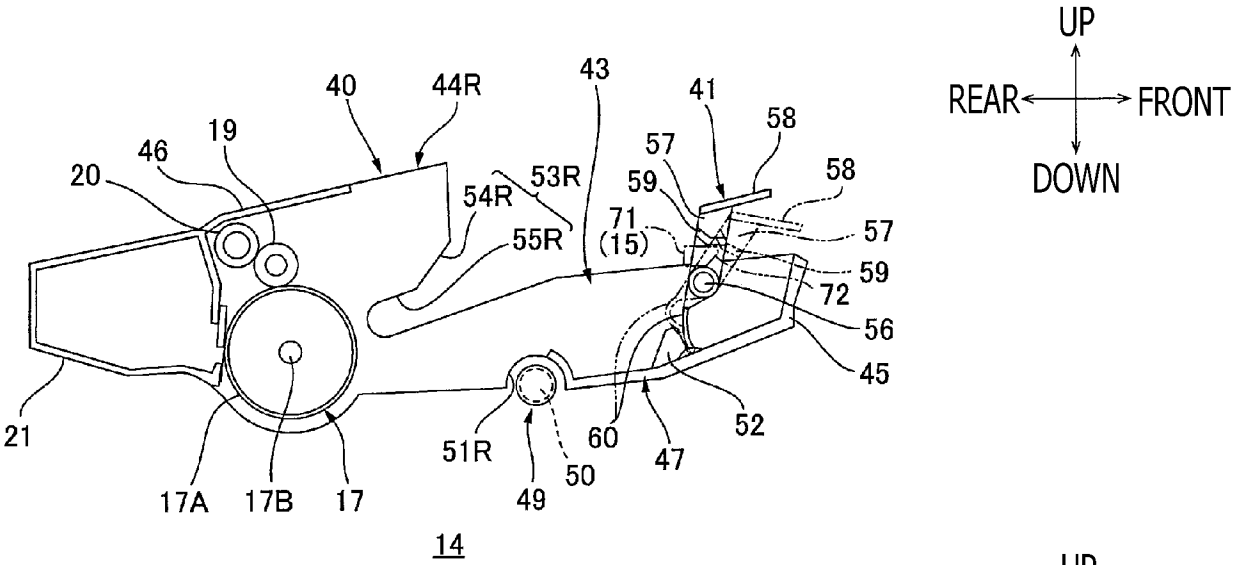
FIG. 2A is a cross-sectional view of a drum cartridge in the image forming apparatus according to the first exemplary embodiment of the present disclosure.
Figure 2B:
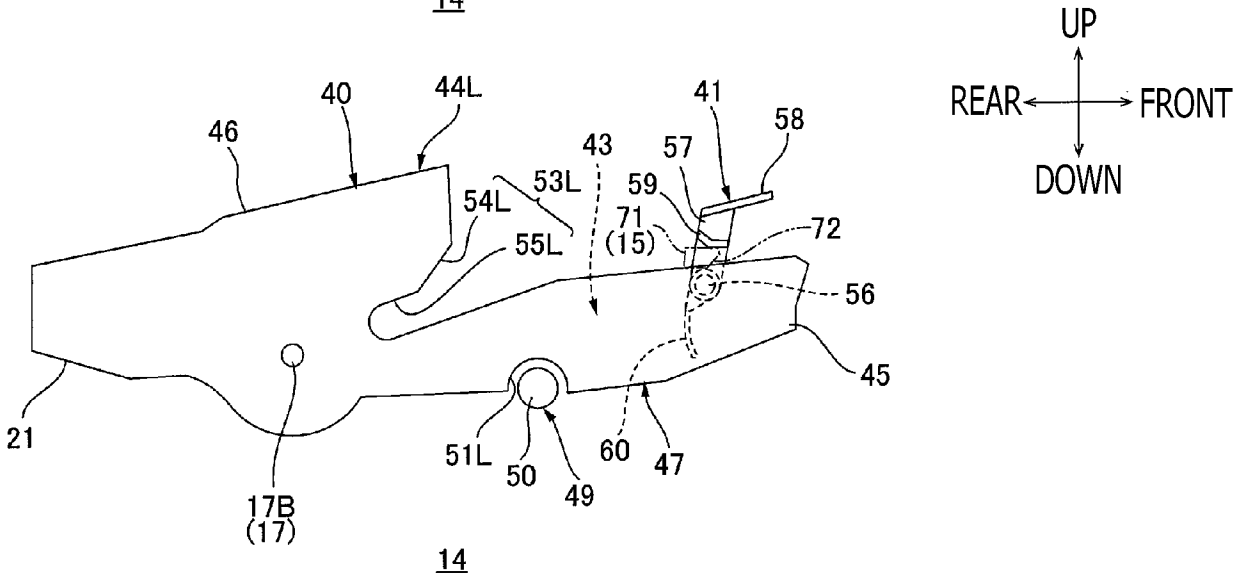
FIG. 2B is a side view of the drum cartridge in the image forming apparatus according to the first exemplary embodiment of the present disclosure.

The drum cartridge 14 includes, as shown in FIGS. 2A and 2B, a drum frame 40 to support the photosensitive drum 17, the second conveyer roller 49, and a switching member 41.

2-1-1. Drum Frame and Second Conveyer Roller

The drum frame 40 includes a side wall 44R on the right, a side wall 44L on the left, a front wall 45, an upper wall 46, and a lower wall 47. The side wall 44R on the right includes a concave part 51R and a groove 53R, and the side wall 44L on the left includes a concave part 51L and a groove 53L.

The side wall 44R is located at, as shown in FIG. 2A, a rightward end of the drum frame 40. The side wall 44R is arranged to spread in the front-rear and vertical directions.

The concave part 51R is located in an approximately central area with regard to the front-rear direction. The concave part 51R is formed to have a shape of a semicircle in a sideward view along the widthwise direction to dent upward from a lower edge of the side wall 44R.

The groove 53R is located in an approximately central area with regard to the front-rear direction in the side wall 44R. The groove 53R is formed to extend in the front-rear direction and is open frontward. The groove 53R is located frontward with respect to the photosensitive drum 17. The groove 53R includes a wider section 54R and a narrower section 55R.

The wider section 54R is located frontward in the groove 53R. The wider section 54R is formed to be smaller in height toward the rear side of the drum frame 40.

The narrower section 55R is formed to extend continuously from a rear end of the wider section 54R to extend rearward. A height of the narrower section 55R is constant.

The side wall 44L is, as shown in FIG. 2B, located at a leftward end of the drum frame 40. The side wall 44L is formed in the similar but symmetrical shape to the side wall 44R.

The front wall 45 is, as shown in FIG. 2A, located at a frontend of the drum frame 40. The front wall 45 is located between a frontend of the side wall 44R and a frontend of the side wall 44L with regard to the widthwise direction and extends in the vertical direction.

The upper wall 46 is located in an upper end area in the drum frame 40. The upper wall 46 is located between an upper end of the side wall 44R and an upper end of the side wall 44L with regard to the widthwise direction and extends in the front-rear direction. The upper wall 46 vertically overlaps the photosensitive drum 17, the charger roller 19, and the charger-cleaning roller 20.

The lower wall 47 is located at a lower end of the drum frame 40. The lower wall 47 is located frontward with respect to the concave parts 51R, 51L. The lower wall 47 is located between the side wall 44R and the side wall 44L with regard to the widthwise direction and extends in the front-rear direction. The lower wall 47 includes a stopper 52.

The stopper 52 is located at a position opposite from the photosensitive drum 17 across the groove 53R with regard to the front-rear direction. The stopper 52 is arranged to project upward from an upper surface of the lower wall 47. The stopper 52 is formed such that a dimension in the front-rear direction is smaller at an upper position and larger at a lower position. In other words, the stopper 52 is formed to have a triangular shape pointing upward in a sideward view along the widthwise direction.

In the drum frame 40, a frontward area with respect to the photosensitive drum 17 forms a toner-cartridge mount 43, in which the toner cartridge 15 may be loaded to be attached to the drum cartridge 14.

Figure 4:
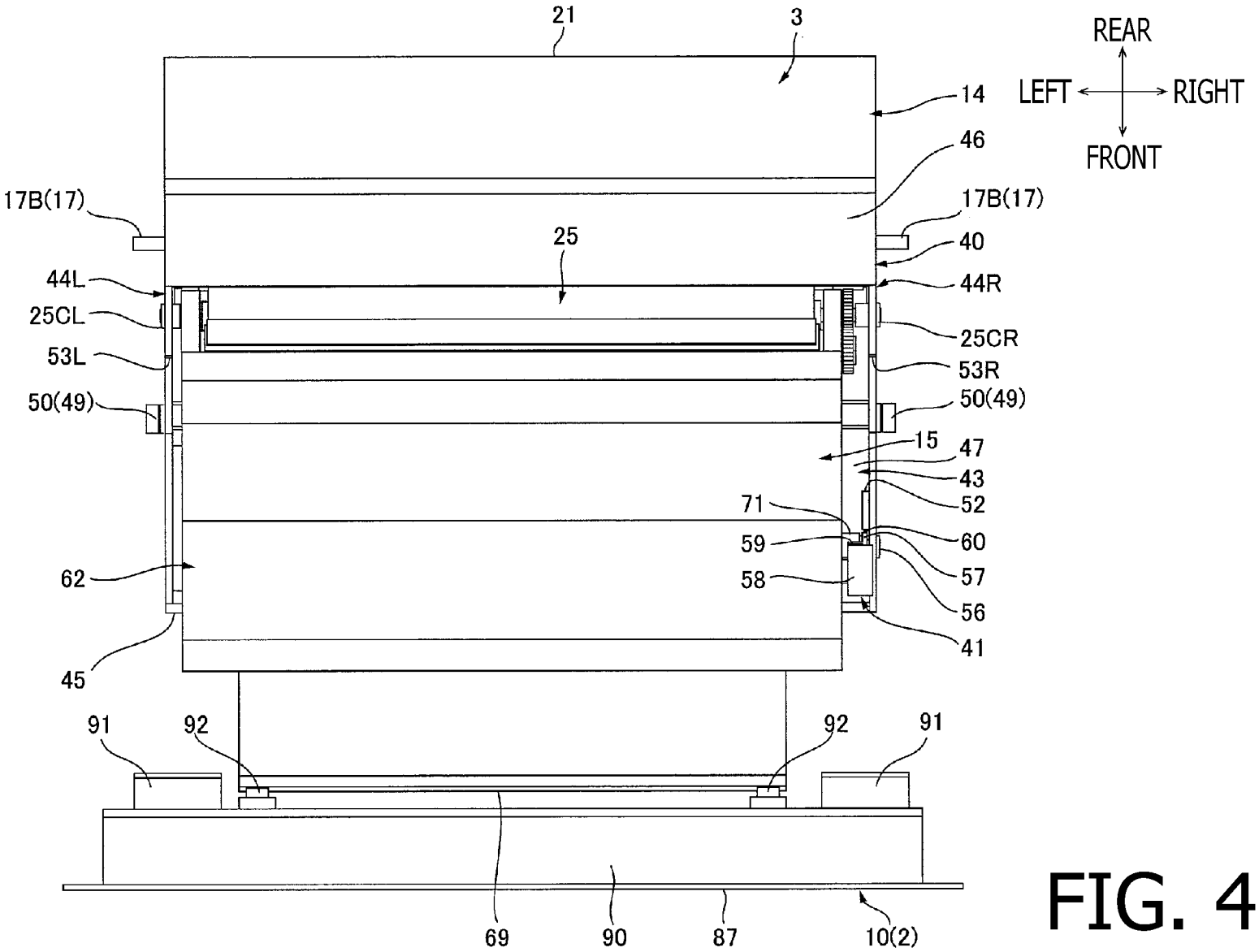
FIG. 4 is a plan view of the process cartridge in the image forming apparatus according to the first exemplary embodiment of the present disclosure.

The second conveyer roller 49 is, as shown in FIGS. 2A and 4, located at an approximately central position with regard to the front-rear direction in the drum cartridge 14. The second conveyer roller 49 is, as shown in FIG. 1, located in an upper position with respect to the first conveyer roller 16 to contact the first conveyer roller 16. The second conveyer roller 49 is formed to have a cylindrical shape axially extending in the widthwise direction and is arranged in, as shown in FIG. 2A, the concave part 51R and the concave part 51L. The second conveyer roller 49 is rotatably supported by the drum frame 40. A rightward end of the second conveyer roller 49 protrudes rightward through the concave part 51R on the right, and a leftward end of the second conveyer roller 49 protrudes leftward through the concave part 51L on the left. The second conveyer roller 49 includes protrusive parts 50, which protrude outward beyond the concave parts 51R, 51L along the widthwise direction.

2-1-2. Switching Member

The switching member 41 may switch states in the drum cartridge 14 between a state, in which the drum cartridge 14 restricts detachment of the toner cartridge 15 from the drum cartridge 14, and a state, in which the drum cartridge 14 releases the toner cartridge 15 from the restriction to be detachable from the toner cartridge 15. The switching member 41 is located in a frontend area in the drum cartridge 14. The switching member 41 is pivotable between a restrictive position, which is indicated in solid lines in FIG. 2A, and a releasable position, which is indicated in dash-and-dots lines in FIG. 2A. The following description concerning the switching member 41 is, unless otherwise noted, based on a basic condition of the switching member 41 being in the restrictive position. The switching member 41 includes a shaft 56, an operable lever 58 being an example of an operable part in the present disclosure, a connector 57, a projection 59 being an example of a second projection in the present disclosure, and a flexible part 60.

The shaft 56 is arranged to be spaced apart farther than the stopper 52 from the photosensitive drum 17 in the front-rear direction. The shaft 56 is formed to have a cylindrical shape axially extending in the widthwise direction. The shaft 56 is rotatably supported by the side wall 44R.

The operable lever 58 is located in an upper end area in the switching member 41. The operable lever 58 may be operated by a user to move the switching member 41 from the restrictive position to the releasable position. The operable lever 58 is formed to have a plate-like shape arranged to spread in the widthwise and front-rear directions.

The connector 57 is, as shown in FIG. 2A, formed to connect the shaft 56 with the operable lever 58. The connector is formed to have a shape of a plate-like piece arranged to spread in the widthwise and front-rear directions.

The projection 59 is located between the shaft 56 and the operable lever 58. The projection 59 is arranged to project inward along the widthwise direction from a widthwise inner surface of the connector 57. The projection 59 is formed to have a plate-like shape spreading in the front-rear and widthwise directions. The projection 59 is formed to bend upper-rearward at a rear part thereof. An amount of clearance between the projection 59 and the shaft 56 is substantially equal to a vertical dimension of a projection 71 being an example of a first projection in the present disclosure, which will be described later.

The flexible part 60 is formed to extend downward from a lower end of the shaft 56. The flexible part 60 is formed to have a rod-like shape and is located frontward with respect to the stopper 52 on the lower wall 47.

2-1-3. Photosensitive Drum

The photosensitive drum 17 includes a cylinder 17A and a drum shaft 17B being an example of a restrictive part in the present disclosure.

The cylinder 17A forms an outer circumference of the photosensitive drum 17 with regard to a direction of radius of the photosensitive drum 17. The cylinder 17A is formed to have a cylindrical shape axially extending in the widthwise direction with widthwise ends thereof being closed. The cylinder 17A includes a photosensitive layer on an outer circumferential surface thereof. A rightward end of the cylinder 17A is rotatably supported by the side wall 44R, and a leftward end of the cylinder 17A is rotatably supported by the side wall 44L.

The drum shaft 17B is located at a center of the photosensitive drum 17 with regard to the direction of radius of the photosensitive drum 17. The drum shaft 17B is formed to have a cylindrical shape axially extending in the widthwise direction. A rightward end of the drum shaft 17B protrudes rightward from the side wall 44R, and a leftward end of the drum shaft 17B protrudes leftward from the side wall 44L.

2-2. Toner Cartridge

Figure 3:
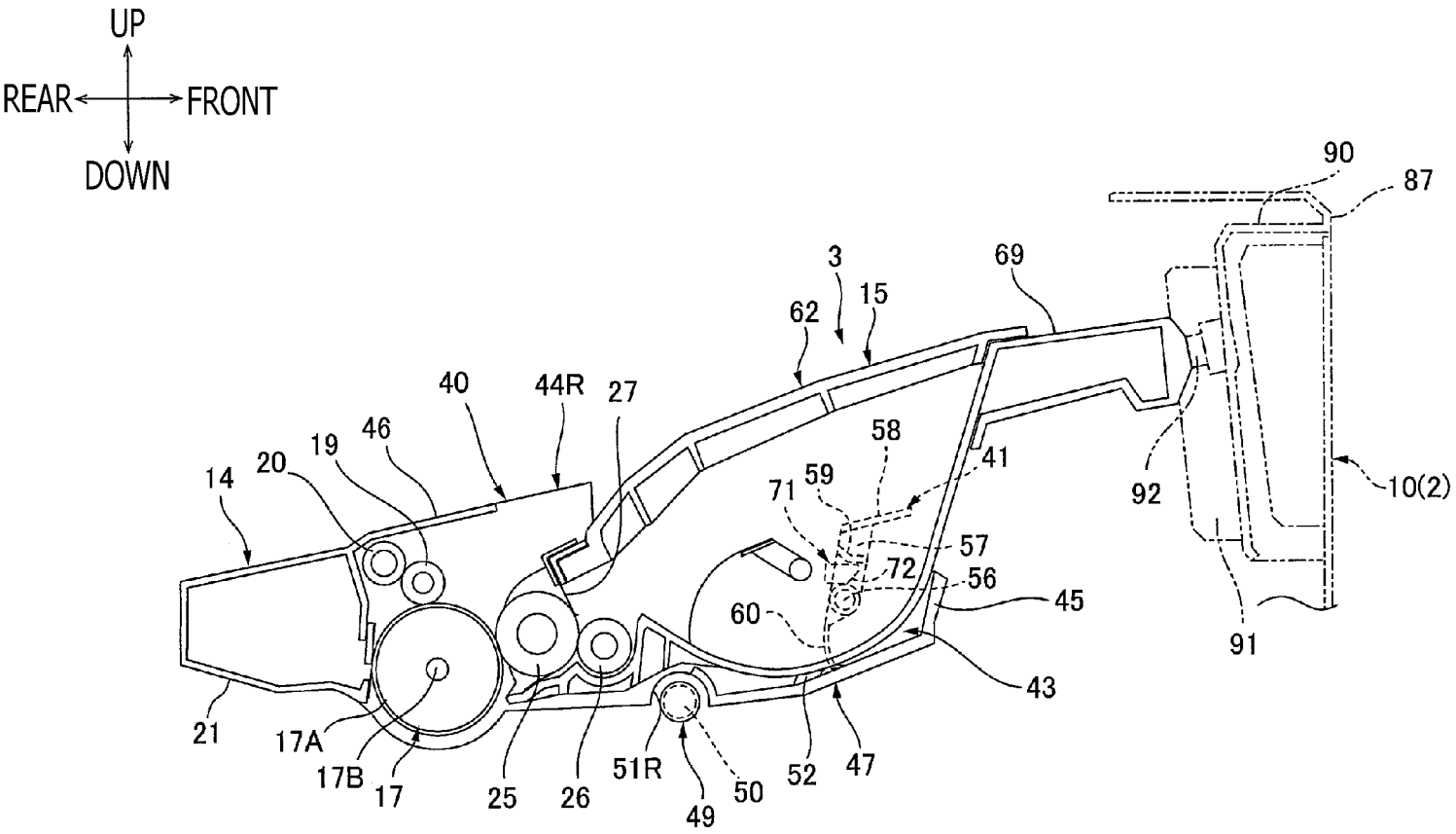
FIG. 3 is a cross-sectional view of a process cartridge in the image forming apparatus according to the first exemplary embodiment of the present disclosure.

The toner cartridge 15 includes, as shown in FIG. 3, a developer frame 62 to support the developer roller 25 and the supplier roller 26, and a handle 69.

2-2-1. Frame and Handle

The developer frame 62 may have an approximate shape of a box and includes a projection 71.

The projection 71 is located at a rightward end in the developer frame 62. The projection 62 is formed to have an approximate shape of a four-sided block arranged to project rightward from a rightward surface of the developer frame 62. The projection 71 includes a slant surface 72.

The slant surface 72 is formed at a front end in of the projection 71. The slant surface 72 extends from a lower end of the projection 71 to incline upper-frontward, or from an upper end of the projection 71 to incline lower-rearward.

The handle 69 is located in a frontend area in the toner cartridge 15. The handle 69 extends frontward continuously from an upper part of the developer frame 62. The handle 69 is, as shown in FIG. 4, formed to have an approximate shape of a rectangular bar longitudinally extends in the widthwise direction. A widthwise dimension of the handle 69 is smaller than a widthwise dimension of the developer frame 62. The developer handle 69 is, when the toner cartridge 15 is attached to the main body 2 as shown in FIG. 1, located closer to the cover 10 than a front end of the drum cartridge 14.

2-2-2. Developer Roller

The developer roller 25 is formed to have a cylindrical shape and is arranged to axially extend in the widthwise direction. The developer roller 25 is rotatably supported by the developer frame 62. The developer roller 25 includes, as shown in FIG. 4, a developer collar 25CR on the right and a developer collar CL on the left.

The developer collar 25CR is located on a rightward end of the developer roller 25 at a rightward position with respect to the developer frame 62. The developer collar 25CR is formed to have a cylindrical shape and arranged to axially extend in the widthwise direction. The developer collar 25CR is arranged to fit on a rightward end of a shaft (unsigned) of the developer roller 25 and is placed to fit in the narrower part 55R in the groove 53R.

The developer collar 25CL is located on a leftward end of the developer roller 25 at a leftward position with respect to the developer frame 62. The developer collar 25CL is formed to have a cylindrical shape and arranged to axially extend in the widthwise direction. The developer collar 25CL is arranged to fit on a leftward end of the shaft of the developer roller 25 and is placed to fit in the narrower part 55L of the groove 53L.

The developer roller 25 is located frontward with respect to the photosensitive drum 17 to contact the photosensitive drum 17.

2-2-3. Conditions of the Toner Cartridge in the Drum Cartridge

The toner cartridge 15 is, as shown in FIG. 3, attachable to the toner-cartridge mount 43 in the drum cartridge 14.

In the drum cartridge 14, when the switching member 41 is in the restrictive position, the projection 71 in the developer frame 62 is placed to fit vertically between the shaft 56 of the switching member 41 and the projection 59. With the projection 71 being fitted with the shaft 56 and the projection 59, the frontend part of the developer frame 62 is restricted from being moved vertically.

Thus, when the switching member 41 in the drum cartridge 14 is in the restrictive position, the projection 71 of the developer frame 62 engages with the projection 59 in the switching member 41 so that the toner cartridge 15 is restricted from being detached from the drum cartridge 14.

On the other hand, when the switching member 41 in the drum cartridge 14 is in the releasable position as indicated in the dash-and-dots lines in FIG. 2A, the projection 71 in the developer frame 62 does not fit in the position between the shaft 56 and the projection 59 in the switching member 41 but is located at an upper position with respect to the shaft 56.

Therefore, the toner cartridge 15 may be released from the restriction from the switching member 41 and allowed to be removed from the drum cartridge 14.

3. Detailed Description of the Main Body

Figure 5:
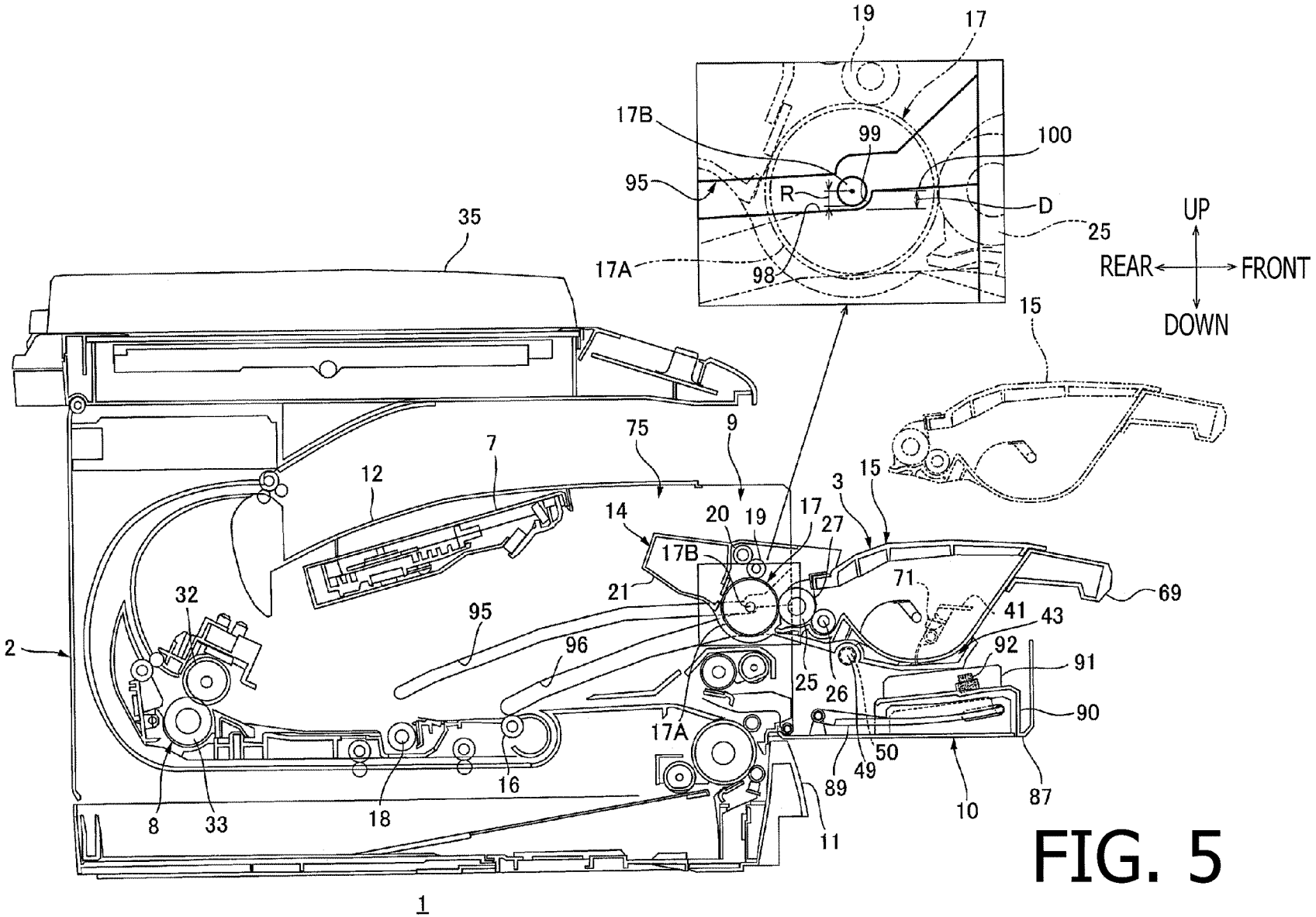
FIG. 5 is an illustrative view of the image forming apparatus with the process cartridge and a toner cartridge being movable from the process cartridge according to the first exemplary embodiment of the present disclosure.

The main body 2 includes, as shown in FIGS. 1 and 5, the cover 10 and two (2) side walls 75, each of which is formed to have grooves 95, 96.

3-1. Cover

The cover 10 includes, as shown in FIG. 1, a covering body 87, two (2) supportive parts 91, two (2) presser parts 92, and a manual-feeder tray 89. The following description of the cover 10 is, unless otherwise noted, based on a basic condition of the cover 10 being in a closing position (see, for example, FIG. 1).

The covering body 87 is formed to have a shape of a plate spreading in the vertical and widthwise directions. The covering body 87 includes a feeder-tray storage 90.

The feeder-tray storage 90 is formed at an approximately central position, in a front view, of the covering body 87 to dent rearward. The feeder-tray storage 90 is formed to have an approximate shape of a box that is open frontward.

The supportive parts 91 are located rearward with respect to the manual-feeder tray 89 on a rearward face of the feeder-tray storage 90. The supportive parts 91 are arranged to project rearward from the rearward face of the feeder-tray storage 90. Each supportive part 91 is formed to have a shape of a rectangular bar longitudinally extending in the vertical direction. As shown in FIG. 4, the supportive parts 91 are arranged to be spaced apart from each other along the widthwise direction. A distance between the supportive parts 91 is greater than a widthwise dimension of the handle 69 on the developer frame 62.

The presser parts 92 are, as shown in FIG. 1, located rearward with respect to the manual-feeder tray 89 on the rearward face of the feeder-tray storage 90. Each presser part 92 is formed to have an approximate shape of a cylindrical block axially extending rearward with a rearward end being closed. The presser part 92 contains a coil spring (not shown) therein. Each presser part 92 is arranged such that a frontward end thereof contacts the rearward face of the feeder-tray storage 90. The presser parts 92 are, as shown in FIG. 4, arranged to be spaced apart from each other along the widthwise direction. A dimension of each presser part 92 in the front-rear direction is, when the coil spring therein is in a condition of natural length, smaller than a dimension of the supportive part 91 in the front-rear direction.

The manual feeder tray 89 is, as shown in FIG. 1, storable inside the feeder-tray storage 90. The manual feeder tray 89 is formed to have a plate-like shape spreading vertically. The manual feeder tray 89 is supported by the covering body 87 swingably about a lower end thereof.

3-2. Side Walls

The side walls 75 are arranged to be spaced apart from each other along the widthwise direction. The side wall 75 on the right and the side wall 75 on the left are in a symmetric and similar form; therefore, the following description concerning the side walls 75 may be represented by the side wall 75 on the right, and description concerning the side wall 75 on the left may be omitted.

The side wall 75 on the right is located on a rightward end of the main body 2. The side wall 75 on the right is formed to have a plate-like shape spreading in the vertical and front-rear directions.

The groove 95 is formed to guide the process cartridge 3 moving in the main body 2. Specifically, the groove 95 may guide the drum shaft 17B of the photosensitive drum 17 in the process cartridge 3 there-along. The groove 95 is formed on an inner (leftward) surface of the side wall 75 on the right to dent outward (rightward) along the widthwise direction. The groove 95 is formed to longitudinally extend in the front-rear direction between an upper position with respect to the transfer roller 18 and the opening 9. A dimension of the groove 95 in the vertical direction may be constant throughout the length in the front-rear direction. The groove 95 includes, as shown in FIG. 5, a guiding surface 98, a restrictor surface 99 being an example of a restrictor in the present disclosure, and a higher surface 100.

The guiding surface 98 is a lower surface in the groove 95 formed to face upward. The guiding surface 98 extends between the upper position with respect to the transfer roller 18 and a frontward end of the side wall 75.

The restrictor surface 99 is turned upward from a frontward end of the guiding surface 98 formed to face rearward. Therefore, with regard to a moving direction for the process cartridge 3 from the first position (see FIG. 1) to the second position (see FIG. 5), the restrictor surface 99 faces upstream. A dimension D of the restrictor surface 99 in the vertical direction may be greater than a radius R of the drum shaft 17B.

The higher surface 100 extends frontward from an upper end of the restrictor surface 99. The higher surface 100 is formed to face upward.

The groove 96 is, as shown in FIGS. 1 and 5, located at a lower position with respect to the groove 95. The groove 96 may guide the process cartridge 3 moving in the main body 2. Specifically, the groove 96 may guide the protrusive part 50 in the second conveyer roller 49 in the process cartridge 3 there-along. The groove 96 is formed on the inner (leftward) surface of the side wall 75 on the right to dent outward (rightward) along the widthwise direction. The groove 96 is formed to longitudinally extend between an upper position with respect to the first conveyer roller 16 and the opening 9.

4. Condition of the Process Cartridge Being in the First Position

When the process cartridge 3 is in the first position, the process cartridge 3 is placed entirely in the inner space formed inside the main body 2 on the inner side with respect to the opening 9.

The widthwise ends of the drum shaft 17B are inserted in a rear end part of each groove 95 formed in the side walls 75.

The photosensitive drum 17 is located above the transfer roller 18 to contact the transfer roller 18.

The protrusive parts 50 in the second conveyer roller 49 are inserted in a rear end part of each groove 96 formed in the side walls 75.

The second conveyer roller 49 is located above the first conveyer roller 16 to contact the first conveyer roller 16.

The condition, in which the photosensitive drum 17 and the transfer roller 18 contact each other, may be recognized as an attached condition for the process cartridge 3 to the main body 2.

The frontward end of the handle 69 contacts the rearward ends of the presser parts 92 of the cover 10 being in the closing position. Thereby, the toner cartridge 15 is pushed rearward, and the developer roller 25 may be stably pressed against the photosensitive drum 17 in the drum cartridge 14.

5. Detachment and Attachment of the Toner Cartridge 5-1. Detachment of the Toner Cartridge The toner cartridge 15 may be detached from the drum cartridge 14 when the cover 10 of the main body 2 is placed in the open position, as shown in FIG. 5.

While the cover 10 is in the open position, the user may grip and pull the handle 69 to draw the process cartridge 3 frontward.

Thereby, the protrusive parts 50 in the second conveyer roller 49 move along the grooves 96 in the side walls 75 toward the opening 9.

Meanwhile, the widthwise ends of the drum shaft 17B in the photosensitive drum 17 move on the guiding surfaces 98 along the grooves 95 in the side walls 75 toward the opening 9.

While the process cartridge 3 is pulled frontward, the widthwise ends of the drum shaft 17B in the photosensitive drum 17 contact the restrictor surfaces 99 in the grooves 95 in the side walls 75.

Thus, the restrictor surfaces 99 may restrict the process cartridge 3 from being drawn further frontward.

Therefore, the position of the process cartridge 3, where the process cartridge 3 is restricted by the restrictor surfaces 99 from moving further frontward, is the second position.

Meanwhile, the frontward part of the process cartridge 3 is located outside the inner space of the main body 2 through the opening 9. Specifically, the switching member 41 in the drum cartridge 14 and the handle 69 in the toner cartridge 15 may be located outside the inner space of the main body 2.

Further, the protrusive parts 50 on the widthwise ends of the second conveyer roller 49 are located outside the inner space of the main body 2. In other words, the protrusive parts 50 of the second conveyer roller 49 are removed off from the grooves 96.

Meanwhile, the photosensitive drum 17 is separated from the transfer roller 18. The photosensitive drum 17 may be entirely or partly placed in the inner space inside the main body 2. The photosensitive drum 17 is supported by the drum shaft 17B being inserted in the grooves 95 and is restricted from contacting other parts, items, or structure inside the main body 2.

Thus, the process cartridge 3 in the second position is supported by the main body 2 solely through the drum shaft 17B in the photosensitive drum 17 and is swingable about the drum shaft 17B.

Therefore, the user may move the process cartridge 3 being in the second position to swing about the drum shaft 17B in the photosensitive drum 17 to be closer to the cover 10 and place the process cartridge 3 to contact the supportive parts 91.

Thus, the process cartridge 3 in the second position may be placed on the supportive parts 91 to be supported by the supportive parts 91.

Next, the user may separate the toner cartridge 15 from the drum cartridge 14, which is supported by the supportive parts 91.

Specifically, the user may detach the toner cartridge 15 from the drum cartridge 14 by operating the operable lever 58 to move the switching member 41 to pivot about the shaft 56, for example, clockwise in a rightward view from the left (see FIG. 2A).

Accordingly, as indicated by dash-and-dots lines in FIG. 2A, the connector 57 in the switching member 41 contacts an upper end of the front wall 45 of the drum cartridge 14. In this state, the projection 59 is in a frontward position with respect to the projection 71.

Meanwhile, a lower end of the flexible part 60 in the switching member 41 contacting the upper end of the front wall 45 is bowed by the stopper 52.

Thus, the switching member 41 is moved from the restrictive position to the releasable position.

The user may grip the handle 69 while the switching member 41 is in the releasable position and pull the toner cartridge 15 upward to separate the toner cartridge 15 from the drum cartridge 14, as shown in FIG. 5.

After being separated from the toner cartridge 15, the drum cartridge 14 may maintain to be supported on the supportive parts 91.

5-2. Attachment of the Toner Cartridge

The toner cartridge 15 may be attached to the drum cartridge 14 when the drum cartridge 14 is supported by the supportive parts 91.

Specifically, the toner cartridge 15 may be placed on the toner-cartridge mount 43 in the drum cartridge 14.

Meanwhile, the lower end of the projection 71 in the toner cartridge 15 may contact the projection 59 in the switching member 41 to press the projection 59 from above. Thereby, as shown in FIG. 2A, the switching member 41 may be moved to rotate about the shaft 56, for example, clockwise in the rightward view from the left.

As the switching member 41 is rotated further, the projection 71 may be placed to the position lower than the projection 59. In this regard, the switching member 41 may move to rotate counterclockwise in the rightward view from the left by resiliency of the flexible part 60.

Thereby, the projection 71 is located in the position between the projection 59 and the shaft 56 to be engaged with the projection 59.

Thus, with the projection 71 being engaged with the projection 59, attachment of the toner cartridge 15 to the drum cartridge 14 may be completed.

The user may, as shown in FIG. 1, push the process cartridge 3 rearward in the main body 2 to place the process cartridge 3 in the first position.

Thereafter, the cover 10 may be placed back in the closing position.

6. Detachment and Attachment of the Process Cartridge

The process cartridge 3 may be detached from the main body 2 when, for example, the drum cartridge 14 is replaced with a new drum cartridge 14, or when the sheet P jammed in the main body 2 is to be removed.

When the process cartridge 3 is to be detached from the main body 2, the user may grip and pull the handle 69 of the process cartridge 3 being in the second position upward to uplift the rearward part of the process cartridge 3 to separate the process cartridge 3 from the main body 2.

Thereby, the widthwise ends of the drum shaft 17B in the photosensitive drum 17 may climb over the restrictor surfaces 99 in the grooves 95 in the side walls 75 to move frontward along the higher surfaces 100.

Thus, the process cartridge 3 may be detached from the main body 2.

When the process cartridge 3 is to be attached in the main body 2, the user may push the process cartridge 3 through the opening 9 into the main body 2.

Thus, the process cartridge 3 may be loaded to be attached to the main body 2, as shown in FIG. 1.

7. Benefits (1) According to the image forming apparatus 1 described above, as shown in FIGS. 1 and 5, the process cartridge 3 is movable between the first position and the second position through the opening 9 while the cover 10 is in the open position.

When the process cartridge 3 is in the second position, the restrictor surfaces 99 in the grooves 95 may restrict the process cartridge 3 from moving further outward. Therefore, the process cartridge 3 may be maintained supported by the supportive parts 91 on the cover 10 while the switching member 41 is held outside the inner space formed inside main body 2.

Thus, the user may operate the switching member 41 easily and smoothly. Therefore, while the process cartridge 3 is stably supported, the user may attach or detach the toner cartridge 15 to or from the drum cartridge 14 for replacement easily.

(2) According to the image forming apparatus 1 described above, as shown in FIG. 5, the process cartridge 3 may be guided by the grooves 95 to contact the restrictor surfaces 99 in the grooves 95.

Therefore, the process cartridge 3 may be securely restricted from moving while the drum shaft 17B is guided in the grooves 95.

(3) According to the image forming apparatus 1 described above, as shown in FIG. 1, the drum shaft 17B may be inserted in the grooves 95 formed in the main body 2.

Thus, the process cartridge 3 may move between the first position and the second position relying on the position of the drum shaft 17B in the photosensitive drum 17.

Therefore, when the process cartridge 3 is in the first position, the cylinder 17A having the photosensitive layer, which may require accuracy in positioning, may be placed in a correct position with respect to the main body 2.

(4) According to the image forming apparatus 1 described above, as shown in FIGS. 1 and 5, the process cartridge 3 may move from the first position to the second position along the grooves 95 to contact the restrictor surfaces 99, which face rearward.

Therefore, the process cartridge 3 may be restricted by the restrictor surfaces 99 securely from moving further outward.

(5) According to the image forming apparatus 1 described above, as shown in FIG. 5, the grooves 95 are formed to have the restrictor surfaces 99; therefore, the drum shaft 17B in the process cartridge 3 being guided by the grooves 95 may contact the restrictor surfaces 99 without failure.

Therefore, the process cartridge 3 may be restricted by the restrictor surfaces 99 securely from moving further outward.

(6) According to the image forming apparatus 1 described above, as shown in FIG. 5, when the process cartridge 3 is in the second position, the photosensitive drum 17 in the process cartridge 3 may be entirely placed inside the inner space inside the main body 2.

Therefore, for example, when the toner cartridge 15 is replaced with a new toner cartridge 15, the photosensitive drum 17 may be prevented from being exposed outside so that adherence of floating substance, such as dust, to the surface of the photosensitive drum 17 may be restrained.

(7) According to the image forming apparatus 1 described above, as shown in FIG. 5, the process cartridge 3 may be placed in the second position when the drum shaft 17B is inserted in the grooves 95 in the main body 2.

Therefore, the photosensitive drum 17 may be securely placed in the inner space.

Therefore, for example, when the toner cartridge 15 is replaced with a new toner cartridge 15, the photosensitive drum 17 may be prevented from being exposed outside so that adherence of floating substance, such as dust, to the surface of the photosensitive drum 17 may be restrained.

(8) According to the image forming apparatus 1 described above, as shown in FIGS. 1 and 4, when the process cartridge 3 is in the first position and the cover 10 is in the closing position, the supportive parts 91 are separated from the process cartridge 3.

Therefore, no force may be caused between the process cartridge 3 and the supportive parts 91, In other words, the process cartridge 3 may be prevented from being subject to a force from the supportive parts 91 unnecessarily. Therefore, an image forming operation with the process cartridge 3 may be stably performed.

(9) According to the image forming apparatus 1 described above, as shown in FIGS. 1 and 4, the presser parts 92 may contact the handle 69 of the toner cartridge 15 in the process cartridge 3, which is in the first position, when the cover 10 is in the closing position, to press the toner cartridge 15 against the photosensitive drum 17.

Therefore, the developer roller 25 may contact the toner cartridge 15 steadily.

Accordingly, the toner may be supplied to the photosensitive drum 17 stably.

(10) According to the image forming apparatus 1 described above, as shown in FIGS. 1 and 4, the cover 10 may provide the supportive parts 91 and the presser parts 92 so that, when the cover 10 is in the open position, the supportive parts 91 may support the process cartridge 3 being in the second position, and when the cover 10 is in the closing position, the presser parts 92 may press the toner cartridge 15 in the process cartridge 3 being in the first position.

(11) According to the image forming apparatus 1 described above, as shown in FIGS. 2A and 3A, the switching member 41 may rotate about the shaft 56.

Therefore, engagement and disengagement between the projection 71 in the developer frame 62 and the projection 59 in the switching member 41 may be easily switched.

(12) According to the image forming apparatus 1 described above, as shown in FIG. 5, when the process cartridge 3 is in the second position, the operable lever 58 is outside the inner space to be exposed from the main body 2.

Therefore, the user may operate the operable lever 58 easily and unmistakably.

8. Second Embodiment

Bellow will be described a second exemplary embodiment of the image forming apparatus 1 according to the present disclosure with reference to FIGS. 6-8. In the following description, items and structures which are identical or equivalent to those described in the previous embodiment may be referred to by the same reference signs, and explanation of those will be omitted.

8-1. Configuration of the Image Forming Apparatus in the Second Embodiment

In the first embodiment described above, as shown in FIG. 1, the process cartridge 3 contains the toner cartridge 15 including the developer roller 25 and the supplier roller 26. However, the process cartridge 3 may not necessarily include the toner cartridge 15 with the developer roller 25 and the supplier roller 26 but may have, as shown in FIG. 6, a toner cartridge 148 to contain toner.

8-1-1. Configuration of the Drum Cartridge

The drum cartridge 14 according to the second embodiment includes the photosensitive drum 17 and the drum frame 40 as described above. Further, the drum cartridge 14 includes a developer device 150 and an arc wall 151 having an inlet 152.

The developer device 150 is located in an approximately central area with regard to the front-rear direction in the drum cartridge 14. The developer device 150 is formed to have an approximate shape of a rectangular box elongated in the widthwise direction. The developer device 150 contains toner therein. The developer device 150 includes the developer roller 25, the supplier roller 26, and the spreader blade 27, which are described above.

The arc wall 151 may serve as a front wall of the developer device 150. The arc wall 151 is formed to have a cross-sectional approximate shape of an arc, which curves and extends upper-frontward at one end of the curve and upper-rearward at the other end of the curve, in a side view along the widthwise direction.

The inlet 152 is located at an approximately central position in the vertical direction of the arc wall 151. The inlet 152 is formed through the arc wall 151 in the front-rear direction to allow communication between inside and outside of the developer device 150.

A part of the drum frame 40 located frontward with respect to the arc wall 151 forms a toner cartridge mount 154, to which the toner cartridge 148 may be attached.

Meanwhile, the side wall 44R of the drum cartridge 14 is not formed to have the groove 53R, which is described in the first embodiment, but is formed to have a groove 156.

The groove 156 may guide the toner cartridge 148 to be attached to or detached from the drum cartridge 14. The groove 156 is formed in the toner cartridge mount 154 on a widthwise inner surface of the side wall 44R to dent outward along the widthwise direction. The groove 156 is formed to extend in the front-rear direction and is open frontward. The groove 156 includes a wider section 157, a narrower section 158, and a first engageable part 159.

The wider section 157 is formed at a frontward position in the groove 156. The wider section 157 is formed to be smaller in height toward the rear side of the side wall 40.

The narrower section 158 is formed to extend continuously from a rear end of the wider section 157 to extend rearward. A height of the narrower section 158 may be constant.

The first engageable part 159 is formed continuously from a rear end of the narrower section 158 to extend upward. The first engageable part 159 is formed to recess in the widthwise direction outward from the widthwise inner surface of the side wall 44R in the drum cartridge 14. The first engageable part 159 is formed to extend along an inner peripheral surface of the arc wall 151.

The side wall 44L is formed to have the groove 156, which is in the same form as the groove 156 formed in the side wall 44R.

8-1-2. Configuration of the Toner Cartridge

Figure 8B:
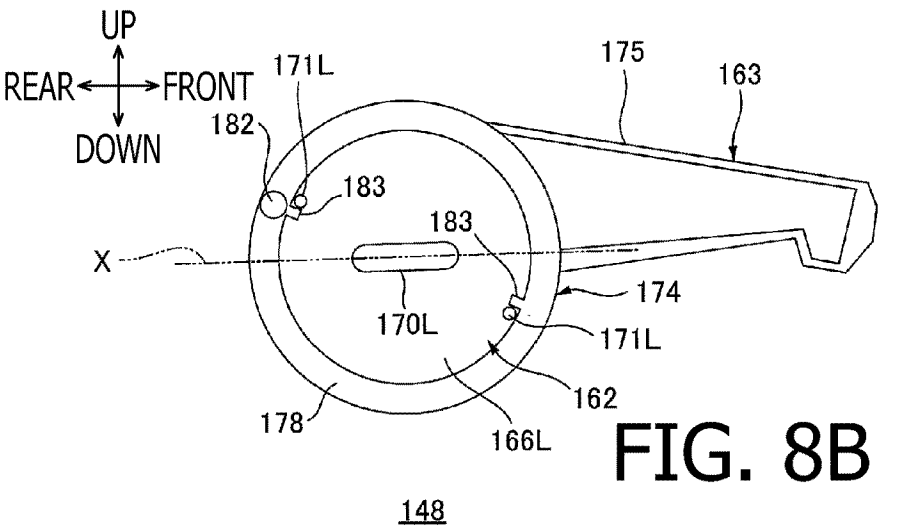
FIGS. 8A and 8B are a cross-sectional view and a side view of the toner cartridge according to the second exemplary embodiment of the present disclosure when the toner cartridge is in the position shown in FIG. 6.

The toner cartridge 148 is attachable to and detachable from the toner cartridge mount 154 in the drum cartridge 14. The toner cartridge 148 includes, as shown in FIGS. 8-8B, a container cylinder 162 having a first toner-opening 165, a switching member 163, and an agitator 167.

The container cylinder 162 is formed to have an approximately cylindrical shape axially extending in the widthwise direction. The container cylinder 162 includes a closure wall 166L on the left and a closure wall 166R on the right.

The closure wall 166L is formed to have an approximate shape of a circular plate in a sideward view along the widthwise direction and is arranged to close a leftward end of the container cylinder 162. The closure wall 166L includes a boss 170L and two (2) stoppers 171L.

The boss 170L is formed to project outward along the widthwise direction from a widthwise outer surface of the closure wall 166L. The boss 170L is formed to have an approximate shape of a bar longitudinally extending in the front-rear direction. The boss 170L is in a shape to fit in the narrower section 158 in the side wall 44L.

The stoppers 171L are located on the closure wall 166L to be spaced apart from each other along the front-rear direction. The stoppers 171L are formed on a circumference of the closure wall 166L. A rearward one of the stoppers 171L is located at an upper position with respect to a rearward end of the boss 170L, and a frontward one of the stoppers 171L is located at a lower position with respect to a frontward end of the boss 170L. Each stopper 171L is formed to have a cylindrical shape axially projecting outward along the widthwise direction from the widthwise outward surface of the closure wall 166L.

The closure wall 166R is formed to have the same shape as the closure wall 166L and closes a rightward end of the container cylinder 162. As shown in FIG. 6, a boss 170R on the closure wall 166R is formed to fit in the narrower section 158 on the side wall 44R.

The agitator 167 is located at an axial center of the container cylinder 162. The agitator 167 may stir the toner contained in the container cylinder 162.

Figure 8A:
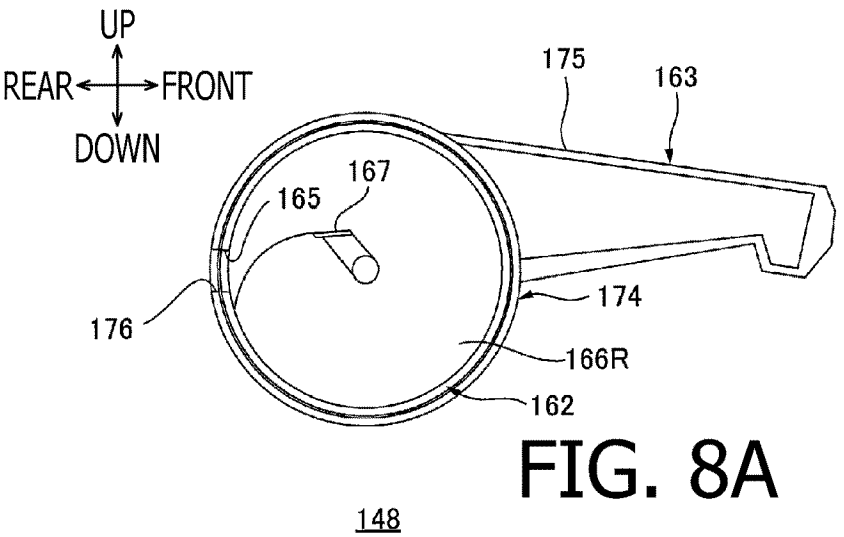

The first toner-opening 165 is, as shown in FIG. 8A, located in a rear end area in the container cylinder 162. The first toner-opening 165 is formed through a rearward end of the container cylinder 162 in the front-rear direction to allow communication between inside and outside of the container cylinder 162. The first toner-opening 165, as shown in FIG. 6, overlap the inlet 152 to align approximately along the front-rear direction.

The switching member 163 may switch states in the process cartridge 3 between a state, in which the toner cartridge 148 is attached to the drum cartridge 14 and is restricted from being detached therefrom; and a state, in which the toner cartridge 148 is released from the restriction and is detachable from the drum cartridge 148. The switching member 163 is pivotable between a restrictive position (see FIG. 6) and a releasable position (see FIG. 7). The following description is, unless otherwise noted, based on a basic condition of the process cartridge 3 being in the second position, the toner cartridge 148 being attached to the drum cartridge 14, ant the switching member 163 being in the restrictive position. The switching member 163 includes an outer cylinder 174 having a second toner-opening 176 and an operable lever 175 being an example of the operable part in the present disclosure.

The outer cylinder 174 is arranged on an outer circumference of the container cylinder 162. The outer cylinder 174 is formed to have a cylindrical shape axially extending in the widthwise direction. The outer cylinder 174 includes, as shown in FIG. 8B, a ring 178, which is arranged on each widthwise end of the outer cylinder 174. In other words, two (2) rings 178 are arranged on the widthwise ends of the outer cylinder 174. The ring 178 on the left and the ring 178 on the right are in an identical shape; therefore, in the following paragraphs, solely the ring 178 on the left may be described, and description of the ring 178 on the right may be omitted.

The ring 178 is located on the leftward end of the outer cylinder 174. The ring 178 is located outward with respect to the container cylinder 162 in the widthwise direction. The ring 178 is formed in a planar layer of ring stretching radially inward from a circumferential edge of the outer cylinder 174. The ring 178 includes a second engageable part 182 and two (2) contact parts 183.

The second engageable part 182 is located at a rearward position in the ring 178. The second engageable part 182 is located above a hypothetical line X extending along the longitudinal direction of the boss 170L. The second engageable part 182 is formed to have a cylindrical shape axially projecting outward in the widthwise direction from a widthwise outer surface of the ring 178. The second engageable part 182 may fit with the first engageable part 159 in the side wall 44L. In other words, the second engageable part 182 is engageable with the first engageable part 159.

The contact parts 183 are located on the ring 178 to be spaced apart from each other along the front-rear direction. The contact parts 183 are on an inner circumference of the ring 178. Each contact part 183 is formed to have a shape of a rectangular bar extending from the inner periphery of the ring 178 inward along a direction of radius in the ring 178. A rearward one of the contact parts 183 is located at a rearward end of the ring 178 and at a frontward position with respect to the second engageable part 182. The rearward one of the contact parts 183 is arranged to contact a lower end of the rearward one of the stoppers 171L. A frontward one of the contact parts 183 is located at a frontward end of the ring 178 and is arranged to contact an upper end of the frontward one of the stoppers 171L.

The second toner-opening 176 is, as shown in FIG. 8A, located in a rear end area in the outer cylinder 174. The second toner-opening 176 is formed through a rear end part of the outer cylinder 174 along the front-rear direction. The second toner-opening 176 aligns with the first toner-opening 165 and the inlet 152 along the front-rear direction to overlap one another. Therefore, through the second toner-opening 176, the first toner-opening 165, and the inlet 152, the container cylinder 162 and the developer device 150 are in communication with each other.

The operable lever 175 is located in a frontend area in the switching member 163. As shown in FIG. 6, when the process cartridge 3 is in the second position, the operable lever 175 is located outside the inner space of the main body 2. On the other hand, when the process cartridge 3 is in the first position, which is not shown, the operable lever 175 is located in the inner space inside the main body 2. The operable lever 175 extends frontward continuously from a frontend part of the outer cylinder 174. The operable lever 175 is formed to have a rectangular bar or pipe longitudinally extending in the widthwise direction.

The switching member 163 is movable from the restrictive position to the releasable position (see FIG. 7) when the operable lever 175 moves upward and the outer cylinder 174 rotates counterclockwise in the rightward view from the left along the outer circumference of the container cylinder 162.

Figure 8D:
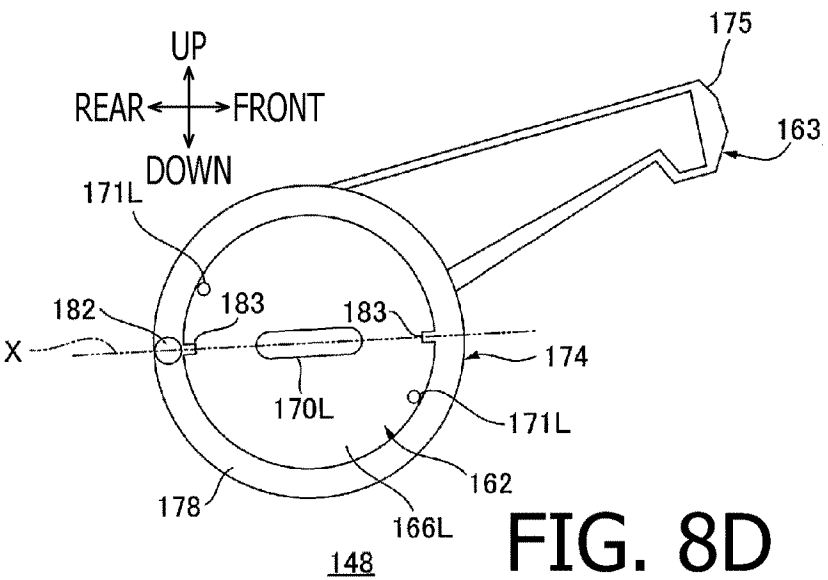
FIGS. 8C and 8D are a cross-sectional view and a side view of the toner cartridge according to the second exemplary embodiment of the present disclosure when the toner cartridge is in the position shown in FIG. 7.
Figure 8C:
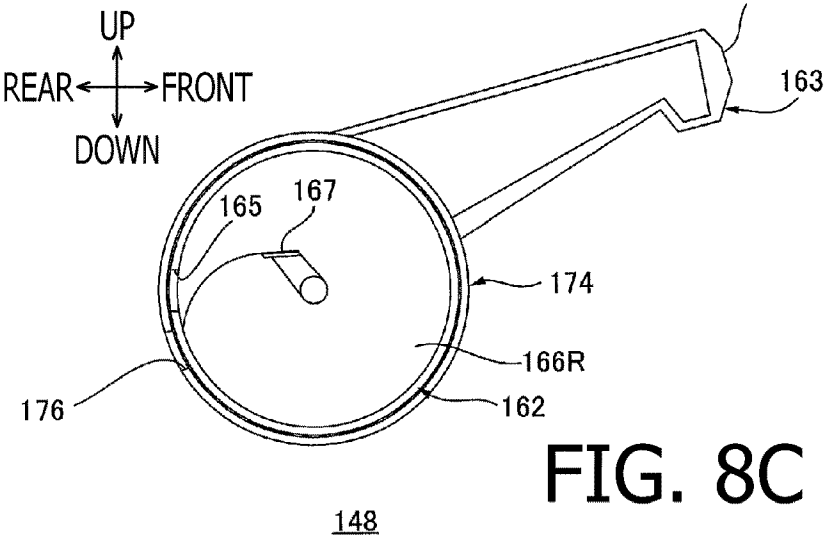

When the switching member 163 is in the releasable position, as shown in FIGS. 8C-8D, the operable lever 175 is arranged to extend upper-frontward from the outer cylinder 174.

Meanwhile, the rearward contact part 183 on the ring 178 is located at a lower position with respect to the rearward stopper 171L, and the frontward contact part 183 on the ring 178 is located at an upper position with respect to the frontward stopper 171L. The second engageable part 182 on the ring 178 is located on the hypothetical line X extending along the longitudinal direction of the boss 170L.

The second toner-opening 176 in the outer cylinder 174 is located to be displaced downward from the first toner-opening 165, and the circumference of the outer cylinder 174 closes the first toner-opening 165.

8-2. Detachment and Attachment of the Toner Cartridge

Figure 6:
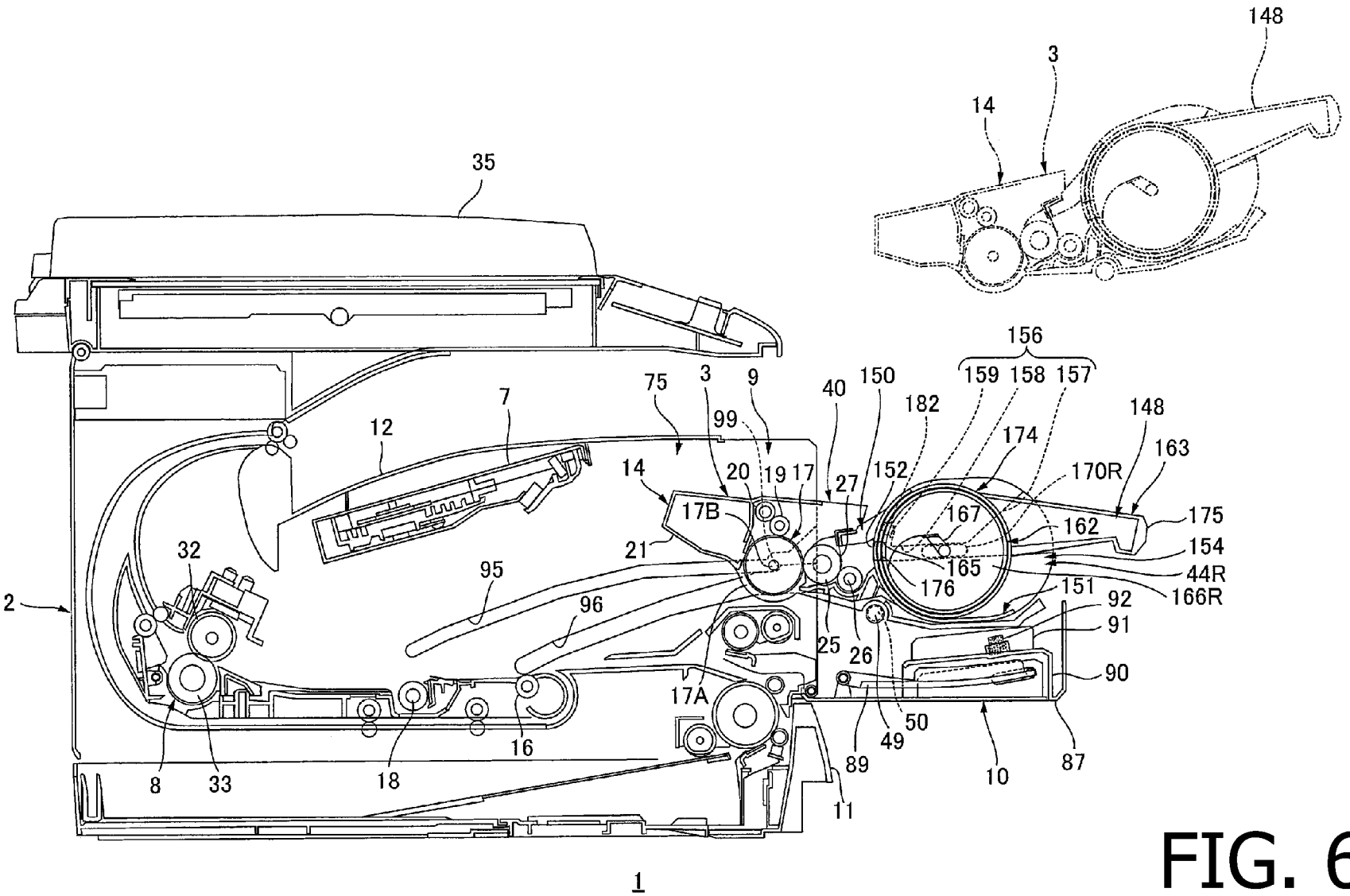
FIG. 6 is a cross-sectional view of an image forming apparatus according to a second exemplary embodiment of the present disclosure with the process cartridge being in a second position and a switching member in the toner cartridge being in a restrictive position.

The toner cartridge 148 may be detached from the drum cartridge 14 when the cover 10 is in the open position, as shown in FIG. 6, similarly to the cover 10 in the first embodiment.

The user may pull the process cartridge 3 until the process cartridge 3 is restricted from moving further frontward at the second position by the restrictor surfaces 99, and the process cartridge 3 may be supported by the supportive parts 91.

Figure 7:
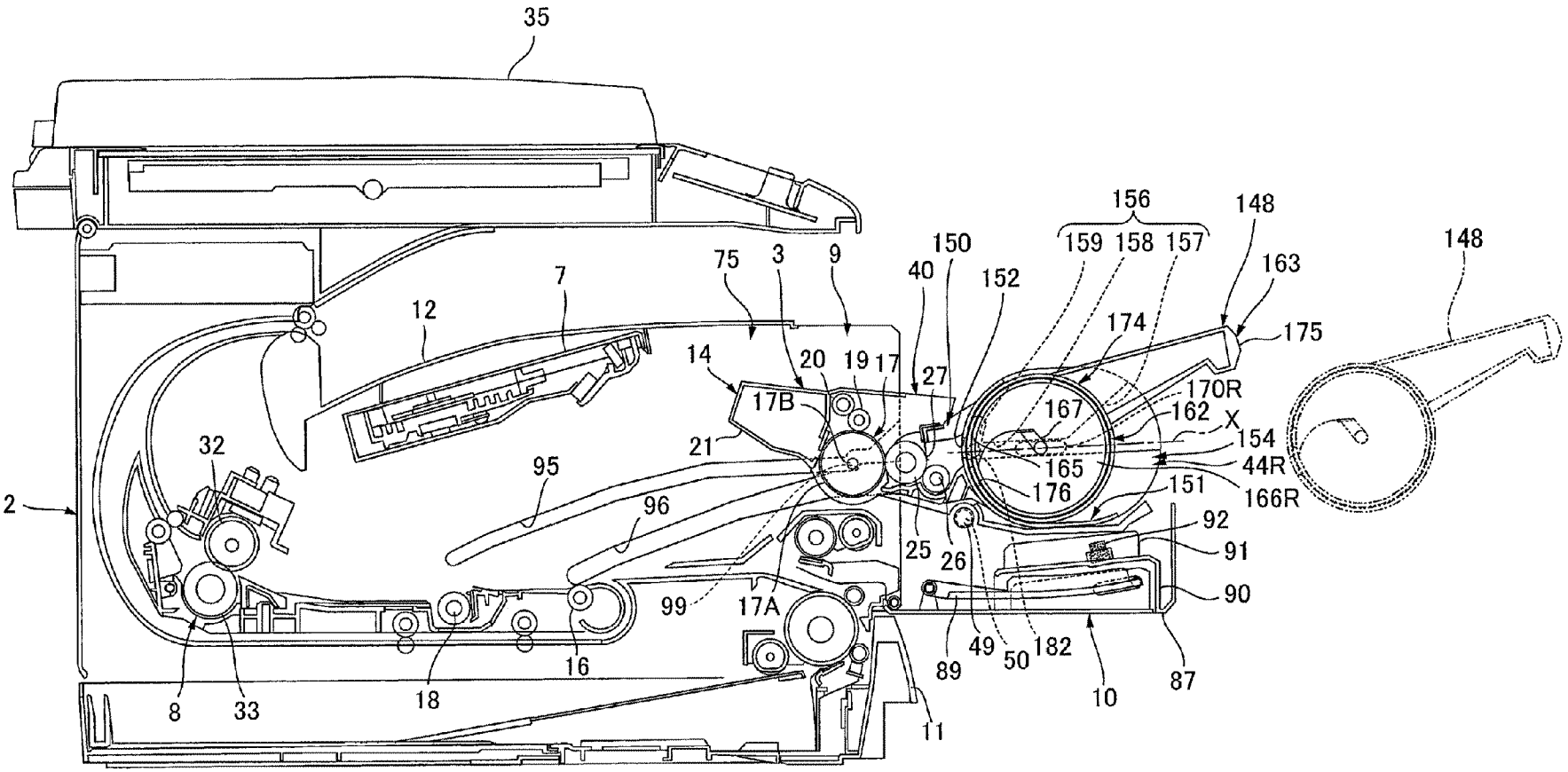
FIG. 7 is a cross-sectional view of the image forming apparatus according to the second exemplary embodiment of the present disclosure with the process cartridge being in the second position and the switching member in the toner cartridge being in a releasable position.

While the drum cartridge 14 is supported on the supportive parts 91, as shown in FIG. 7, the user may detach the toner cartridge 148 from the drum cartridge 14.

Specifically, the user may operate the operable lever 175 of the switching member 163 to rotate the outer cylinder 174 counterclockwise in the rightward view from the left.

Thereby, the second engageable part 182 moves to the lower end of the first engageable part 159 to contact the lower end of the narrower section 158. Meanwhile, the second engageable part 182 on the ring 178 is located on the hypothetical line X.

Therefore, the second toner-opening 176 in the outer cylinder 174 is moved downward to be displaced from the first toner-opening 165, and the circumference of the outer cylinder 174 closes the first toner-opening 165.

Thus, the switching member 163 is placed in the releasable position, and the toner cartridge 148 is released from the restriction of the drum cartridge 14 so that the toner cartridge 148 is detachable from the drum cartridge 14.

Next, the user may grip the operable lever 175 of the toner cartridge 148, which is detachable from the drum cartridge 14 to pull the toner cartridge 148 upper-frontward. Accordingly, the boss 170L and the second engageable part 182 on the left are guided in the narrower section 158 and the wider section 157, and the boss 170R and the second engageable part 182 on the right are guided in the narrower section 158 and the wider section 157. Thus, the toner cartridge 148 may be detached from the drum cartridge 14.

The toner cartridge 148 may be attached to the drum cartridge 14 being supported by the supportive parts 91.

Specifically, the second engageable part 182 and the boss 170L on the left are guided in the wider section 157 and the narrower section 158 on the left, and the second engageable part 182 and the boss 170R on the right are guided in the wider section 157 and the narrower section 158 on the right.

Next, the user may operate the operable lever 175 to rotate the outer cylinder 174 clockwise in the rightward view from the left.

Thereby, the switching member 163 is placed in the restrictive position, and the toner cartridge 148 is attached to the drum cartridge 14 so that the toner cartridge 148 is restricted from being detached from the drum cartridge 14.

Thus, attachment of the toner cartridge 148 to the drum cartridge 14 may be completed.

Thereafter, the user may push the process cartridge 3 inside the main body 2 to place the process cartridge 3 in the first position.

Thereafter, the cover 10 may be placed back in the closing position.

8-3. Benefits by the Second Embodiment (1) According to the image forming apparatus 1 in the second embodiment, as shown in FIGS. 6-7, the outer cylinder 174 is rotatable with respect to the container cylinder 162.

Therefore, engagement and disengagement between the first engageable part 159 in the drum cartridge 14 and the second engageable part 182 in the toner cartridge 148 may be easily switched.

Further, connection and disconnection between the first toner-opening 165 in the container cylinder 162 and the second toner-opening 176 in the outer cylinder 174 may be easily switched.

(2) According to the image forming apparatus 1 in the second embodiment, as shown in FIG. 6, engagement between the first engageable part 159 and the second engageable part 182 may be easily achieved by the uncomplicated structure of the concave-and-convex form.

(3) According to the image forming apparatus 1 in the second embodiment, as shown in FIG. 6, the operable lever 175 may be placed outside the main body 2 when the cover 10 is open; therefore, the user may reach the operable lever 175 and move the operable lever 175 easily.

(4) Further, according to the image forming apparatus 1 in the second embodiment, the benefits achievable by the image forming apparatus 1 in the first embodiment may be achieved likewise.

9. Third Embodiment

Bellow will be described a third exemplary embodiment of the image forming apparatus 1 according to the present disclosure with reference to FIG. 9. In the following description, items and structures which are identical or equivalent to those described in the previous embodiments may be referred to by the same reference signs, and explanation of those will be omitted.

9-1. Configuration of the Image Forming Apparatus in the Third Embodiment

In the first embodiment described above, as shown in FIG. 5, the restrictor surfaces 99 in the grooves 95 restrict the process cartridge 3 from moving frontward and place the process cartridge 3 in the second position. However, the grooves 95 may not necessarily have the restrictor surfaces 99 to restrict the process cartridge 3 from moving frontward but may have blade springs 190, being another example of the restrictor and an example of a spring in the present disclosure, that may restrict the process cartridge 3 from moving frontward and place the process cartridge 3 in the second position.

Figure 9:
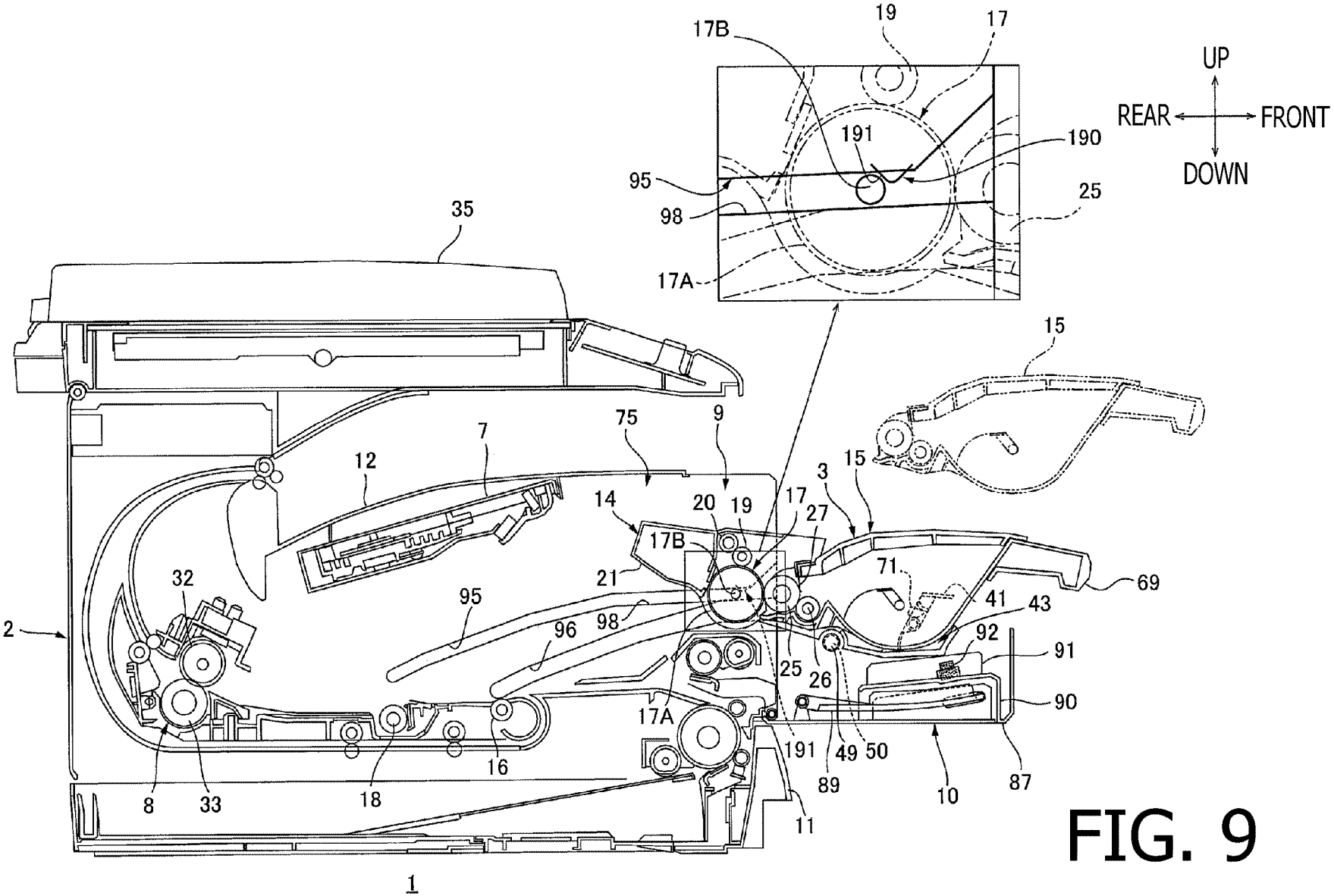
FIG. 9 is a cross-sectional view of an image forming apparatus according to a third exemplary embodiment of the present disclosure.

As shown in FIG. 9, the grooves 95 in the third embodiment may each have a blade spring 190 that may restrict the process cartridge 3 from moving frontward to place the process cartridge 3 in the second position.

The blade spring 190 may be located in a frontend area in the groove 95. The blade spring 190 may be arranged to project downward from an upper surface in the groove 95. A distance between a lower end of the blade spring 190 and the lower surface of the groove 95 is smaller than a diameter of the drum shaft 17B of the photosensitive drum 17. The blade spring 190 includes a restrictor surface 191 that faces rearward.

The restrictor surface 191 may extend diagonally along a line (not shown) extending through an upper-rearward position and a lower-frontward position to face rearward. In other words, with regard to a moving direction for the process cartridge 3 from the first position to the second position, the restrictor surface 191 faces upstream.

When the toner cartridge 15 is to be detached from the drum cartridge 14, the user may pull the process cartridge 3 outward from the main body 2 in the same procedure as the procedure described in the first embodiment.

While the process cartridge 3 is being pulled frontward, the widthwise ends of the drum shaft 17B of the photosensitive drum 17 may contact the restrictor surfaces 191 of the blade springs 190 in the grooves 95.

When an amount of force to pull the process cartridge 3 outward is smaller than an amount of resilient force of the blade springs 190, the restrictor surfaces 191 of the blade springs 190 may restrict the process cartridge 3 from moving further outward and maintain the process cartridge 3 in the second position.

While the process cartridge 3 is placed in the second position, the toner cartridge 15 may be attached to or detached from the drum cartridge 14.

In the meantime, when the process cartridge 3 is to be detached from the main body 2, the user may grip and pull the handle 69 of the process cartridge 3 being in the second position frontward along the grooves 95.

In this regard, the user may need to pull the process cartridge 3 outward with an amount of pulling force being greater than the amount of the resilient force in the blade springs 190.

With the greater amount of pulling force than the amount of the resilient force in the blade springs 190, the drum shaft 17B of the photosensitive drum 17 may uplift the blade springs 190 against the resilient force and move frontward beyond the blade springs 190.

When the process cartridge 3 is to be attached to the main body 2, the user may place the drum shaft 17B of the photosensitive drum 17 in the grooves 95 and push the process cartridge 3 into the main body 2.

The drum shaft 17B pressed against the blade springs 190 may uplift the blade springs 190 against the resilient force and move rearward beyond the blade springs 190.

9-2. Benefits by the Third Embodiment

According to the image forming apparatus 1 in the third embodiment, as shown in FIG. 9, the process cartridge 3 may be restricted from moving by the uncomplicated structure of the blade springs 190 having the restrictor surfaces 191 to be placed in the second position.

Further, according to the image forming apparatus 1 in the third embodiment, the benefits achievable by the image forming apparatus 1 in the first embodiment may be achieved likewise.

10. Fourth Embodiment

Figure 10:
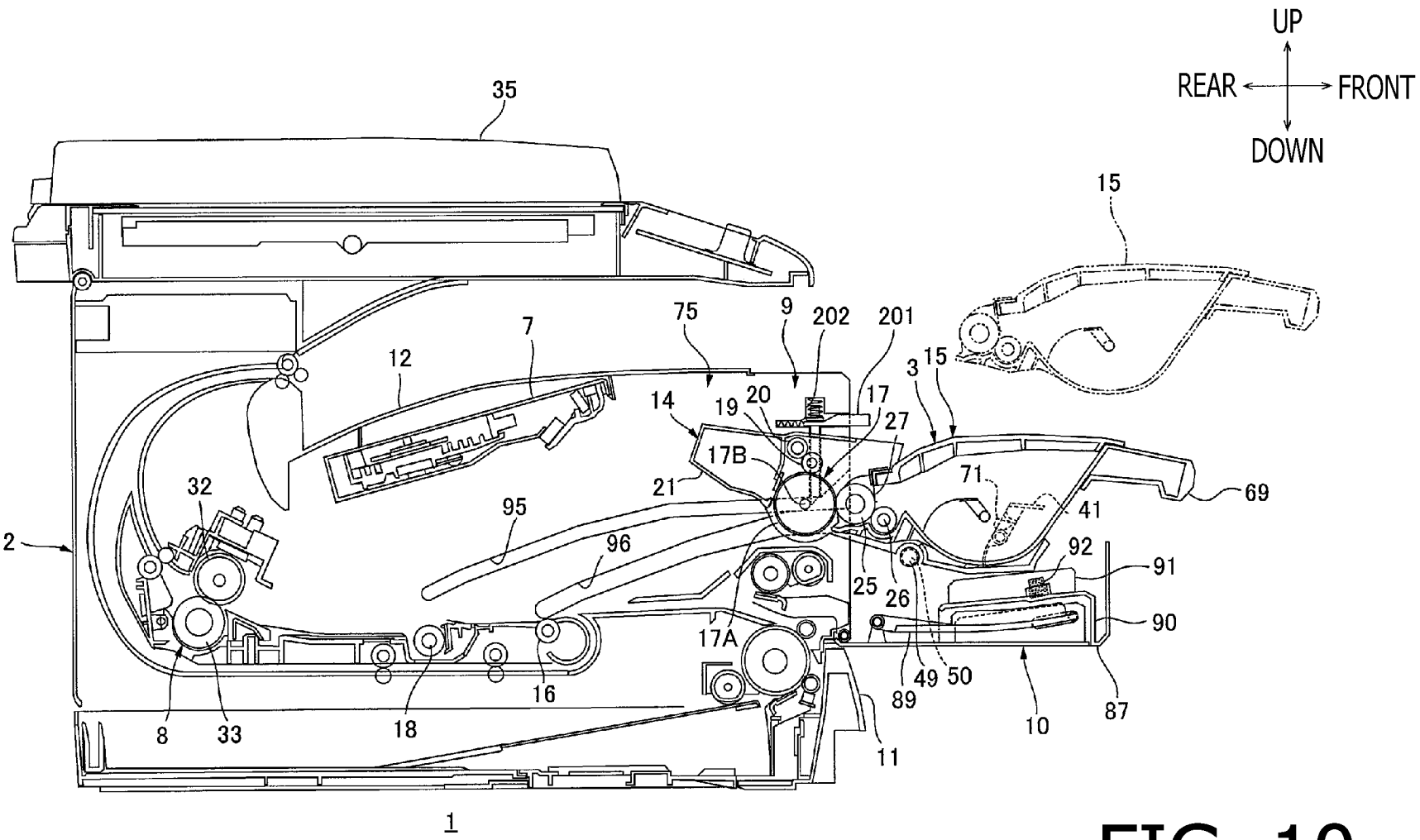
FIG. 10 is a cross-sectional view of an image forming apparatus according to a fourth exemplary embodiment of the present disclosure.

Bellow will be described a fourth exemplary embodiment of the image forming apparatus 1 according to the present disclosure with reference to FIGS. 10-11B. In the following description, items and structures which are identical or equivalent to those described in the previous embodiments may be referred to by the same reference signs, and explanation of those will be omitted.

10-1. Overall Configuration of the Image Forming Apparatus in the Fourth Embodiment In the first embodiment described above, as shown in FIG. 5, the restrictor surfaces 99 in the grooves 95 may restrict the process cartridge 3 from moving frontward and place the process cartridge 3 in the second position.

Meanwhile, in the third embodiment described above, as shown in FIG. 9, the blade springs 190 in the grooves 95 may restrict the process cartridge 3 from moving frontward and maintain the process cartridge 3 in the second position.

However, the grooves 95 may not necessarily have the restrictor surfaces 99 or the blade springs 190 to restrict the process cartridge 3 from moving frontward, but each or at least one of the side walls 75 may have a housing 202 that may accommodate a restrictor device 201, which is another example of the restrictor, to restrict the process cartridge 3 from moving frontward and place the process cartridge 3 in the second position.

10-2. Detailed Configuration of the Image Forming Apparatus in the Fourth Embodiment The housing 202 is located at an frontward area in the side wall 75. The housing 202 includes, as shown in FIG. 11A, a cam housing 204 and a pin housing 205.

The cam housing 204 is formed in an upper and spaced-apart position with respect to the groove 95. The cam housing 204 is formed to recess rearward from a front face of the side wall 75 to extend in the front-rear direction.

The pin housing 205 is formed to extend upward from an upper end of the groove 95 along the vertical direction. The pin housing 205 is formed to intersect with the cam housing 204. An upper end of the pin housing 205 is in an upper position with respect to the cam housing 204. Meanwhile, a rear end of the cam housing 204 is in a rearward position with respect to the pin housing 205.

In the housing 202, accommodated is the restrictor device 201, which includes a cam 208, a first urging member 209, a pin 210, and a second urging member 211.

The cam 208 is arranged in the cam housing 204. The cam 208 is arranged to extend longitudinally in the front-rear direction. The cam 208 includes a frontward portion 214, a rearward portion 215, and a central portion 216.

The frontward portion 214 forms a frontward part of the cam 208. The frontward portion 214 is in an approximate shape of a rectangular block extending longitudinally along the front-rear direction.

The rearward portion 215 forms a rearward part of the cam 208. The rearward portion 215 is in an approximate shape of a rectangular block extending longitudinally along the front-rear direction. A dimension of the rearward portion 215 in the vertical direction is smaller than a dimension of the frontward portion 214 in the vertical direction.

The central portion 216 forms a central part with regard to the front-rear direction in the cam 208 to connect the frontward part 214 and the rearward part 215. An upper surface of the central portion 216 inclines between an upper surface of the frontward portion 214 and an upper surface of the rearward portion 215. Specifically, the upper surface of the central portion 216 inclines lower-rearward to be lower toward the rearward portion 215.

The first urging member 209 is located in a rearward area in the restrictor device 201. The first urging member 209 may be a coil spring extending in the front-rear direction. A frontward end of the first urging member 209 is fixed to the rearward portion 215 in the cam 208, and a rearward end of the first urging member 209 is fixed to a rear end of the cam housing 204. The first urging member 209 is arranged to urge the cam 208 frontward to be away from the rear end of the can housing 204 under a normal condition.

The cam 208 is movable by the urging force of the first urging member 209 between a protrusive position (see FIG. 11A), in which the frontward portion 214 protrudes frontward from the side wall 75, and a stored position (see FIG. 11B), in which the frontward portion 214 is accommodated in the cam housing 204 against the urging force of the first urging member 209.

Meanwhile, the pin 210 is located in the pin housing 205. The pin 210 is in an approximate shape of a rectangular bar extending longitudinally along the vertical direction. The pin 210 is arranged to intersect with the cam 208 and penetrates the cam 208. An upper end of the pin 210 is located at an upper position with respect to the cam 208. Meanwhile, a rearward end of the cam 208 is located rearward with respect to the pin 210. A lower end of the pin 210 may protrude from the pin housing 202 into the groove 95. The pin 210 includes a restrictor surface 220 being a rearward surface. The lower end of the pin 210 is formed diagonally to have a slant surface 221, which inclines upper-frontward to be higher toward the front.

The pin 210 includes a contact part 219 formed at an upper part thereof. The contact part 219 may contact the upper surface of the rearward portion 215 of the cam 208. The contact portion 219 is in a plate-like shape protruding from peripheral surfaces of the pin 210.

The second urging member 211 is located in an upper area in the restrictor device 201. The second urging member 211 may be a coil spring extending in the vertical direction. A lower end of the second urging member 211 is fixed to the contact part 219 of the pin 210, and an upper end of the second urging member 211 is fixed to an upper end of the pin housing 205. The second urging member 211 is arranged to urge the pin 210 downward under a normal condition to place the contact part 219 to contact the cam 208.

Thus, the pin 210 urged by the second urging member 211 is movable between a blocking position (see FIG. 11A), in which the lower end of the pin 210 protrudes in the groove 95, and a retracted position (see FIG. 11B), in which the lower end of the pin 210 is retracted in the pin housing 205.

10-3. Detachment and Attachment of the Toner Cartridge and the Process Cartridge The toner cartridge 15 may be detached from the drum cartridge 14 while the process cartridge 3 is pulled out of the main body 2 in the similar procedure to the procedure described above in the first embodiment.

While the process cartridge 3 is being pulled frontward, a widthwise (e.g., rightward) end of the drum shaft 17 of the photosensitive drum 17 may contact the restrictor surface 220 of the pin 210 in the blocking position.

Thus, the restrictor surface 220 of the pin 210 may restrict the process cartridge 3 from further frontward and place the process cartridge 3 in the second position.

While the process cartridge 3 is placed in the second position, the toner cartridge 15 may be attached to or detached from the drum cartridge 14.

Figure 11B:
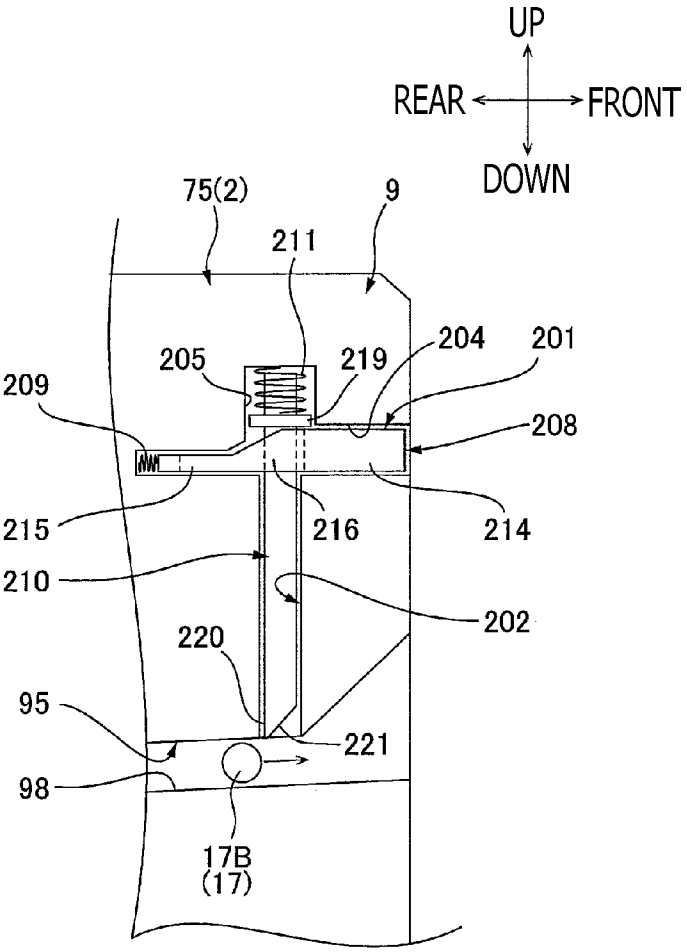
FIG. 11B is an enlarged view of the restrictor device with the pin being in a withdrawn position in the image forming apparatus according to the fourth exemplary embodiment of the present disclosure.
Figure 11A:
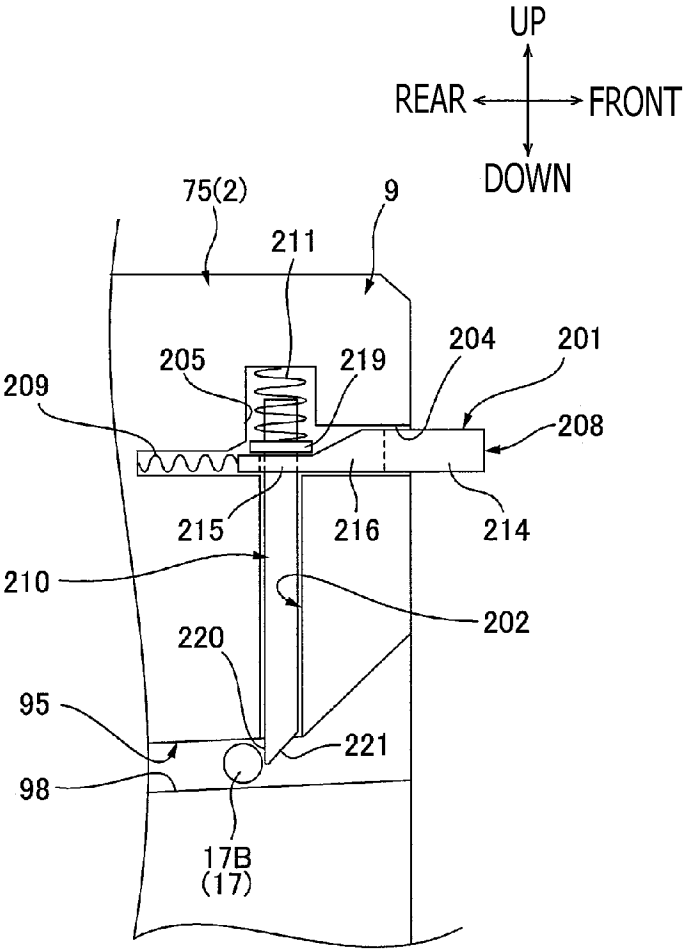
FIG. 11A is an enlarged view of a restrictor device with a pin being in a blocking position in the image forming apparatus according to the fourth exemplary embodiment of the present disclosure.

In order to detach the process cartridge 3 from the main body 2, the user may push the cam 208 in the restrictor device 201 rearward, as shown in FIG. 11B, to move the cam 208 from the protrusive position to the stored position.

The contact part 219 of the pin 210 may climb on the central portion 216 in the cam 208 and may be moved upward.

Thereby, the pin 210 may move from the blocking position to the retracted position against the urging force of the second urging member 211.

Thus, the groove 95 may be open to the drum shaft 17B and allow the drum shaft 17B to move frontward.

The user may grip the handle 69 of the process cartridge 3 being in the second position and pull the process cartridge 3 frontward along the grooves 95.

When the process cartridge 3 is to be loaded in the main body 2, the user may insert the drum shaft 17B of the photosensitive drum 17 in the grooves 95 and push the process cartridge 3 through the opening 9 into the main body 2.

The rightward end of the drum shaft 17B of the in the groove 95 may contact the slant surface 221 of the pin 210.

Thereby, the pin 210 may move upward against the urging force of the second urging member 211 to allow the drum shaft 17B to move further rearward.

Thus, the process cartridge 3 may be loaded to be attached to the main body 2.

10-4. Benefits by the Fourth Embodiment

According to the image forming apparatus 1 in the fourth embodiment, as shown in FIGS. 11A-11B, the process cartridge 3 may be restricted from moving from the second position or released from the restriction by the uncomplicated structure of the pin 210 with the restrictor surface 220, which is movable between the blocking position and the retracted position.

Further, according to the image forming apparatus 1 in the fourth embodiment, the benefits achievable by the image forming apparatus 1 in the first embodiment may be achieved likewise.

11. Modified Example of the Fourth Embodiment

The process cartridge 3 in the fourth embodiment may be restricted from moving from the second position by the pin 210 in the restrictor device 201, which may protrude downward in to the groove 95 to close the groove 95 and contact the rightward end of the drum shaft 17B of the photosensitive drum 17.

However, for example, the pin 210 may not necessarily protrude downward but may protrude in the widthwise direction in the inner space in the main body 2.

Figure 12B:
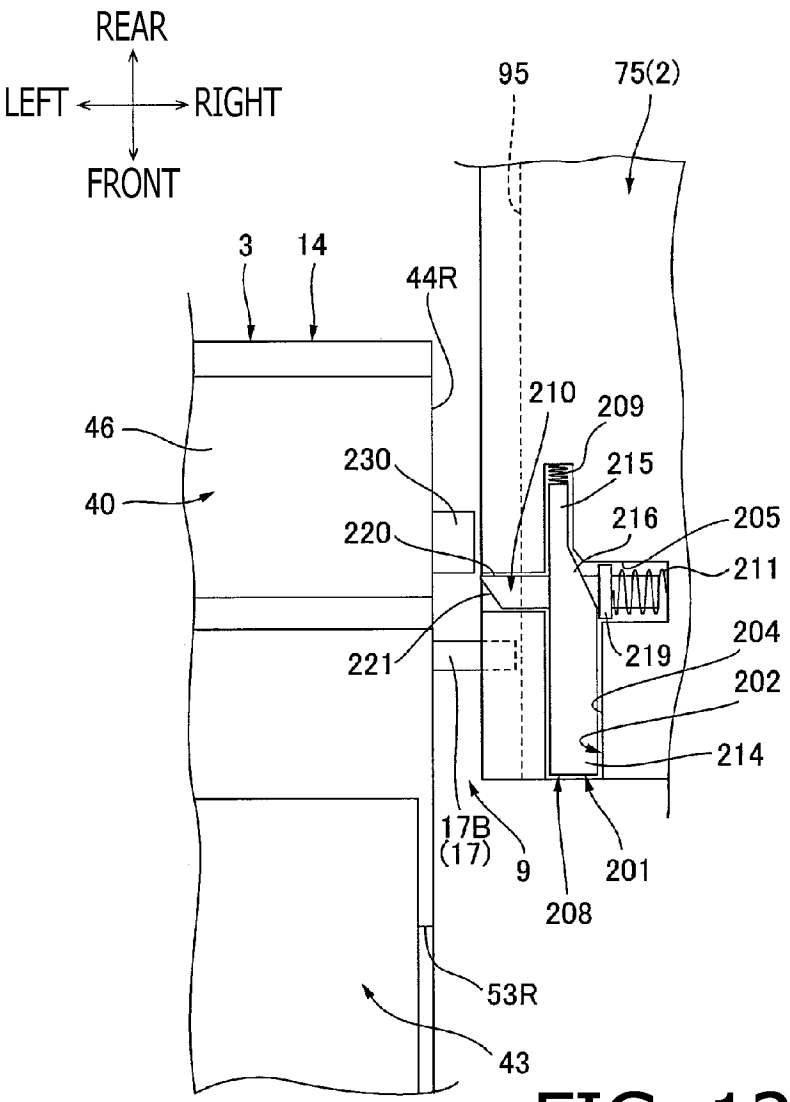
FIG. 12B is an enlarged view of the restrictor device with the pin being in the withdrawn position in the image forming apparatus according to the modified exemplary embodiment of the present disclosure.
Figure 12A:
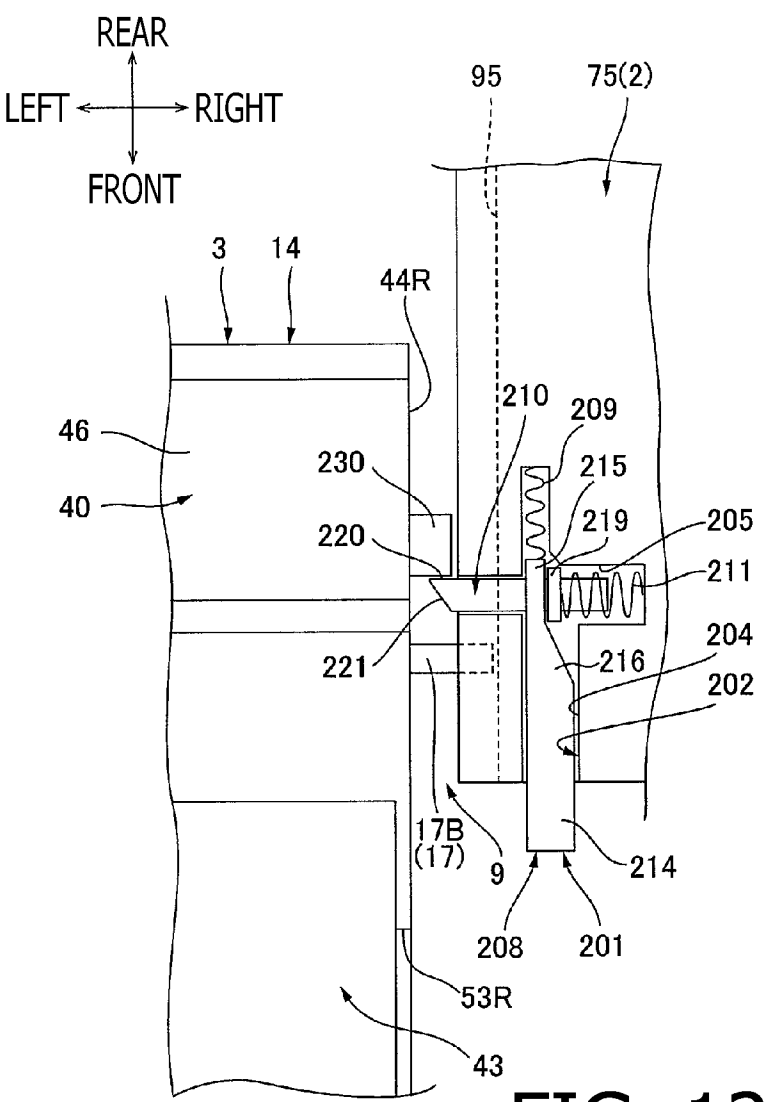
FIG. 12A is an enlarged view of the restrictor device with the pin being in the blocking position in an image forming apparatus according to a modified exemplary embodiment of the present disclosure.

Further, the pin 210 with the restrictor surface 220 may not necessarily contact the drum shaft 17B of the photosensitive drum 17 to block but may contact a projection 230 of the process cartridge 3 (see FIGS. 12A-12B).

In the modified example, the pin housing 205 may be formed to recess outward in the widthwise direction from the widthwise inner surface of the side wall 75. Therefore, the pin 210 of the restrictor device 201 in the housing 202 may be arranged to protrude inward in the widthwise direction from the side wall 75.

The projection 230 may be located at a rearward area in the drum cartridge 14. The projection 230 may be formed to have an approximate shape of a cylinder axially extending in the widthwise direction and protrude outward in the widthwise direction from the side wall 44R of the drum cartridge 14. A rightward end of the projection 230 may be at an inner position with respect to a rightward end of the drum shaft 17B with regard to the widthwise direction.

The toner cartridge 15 may be detached from the drum cartridge 14 while the process cartridge 3 is drawn out of the main body 2 in the similar procedure to the procedure described above in the fourth embodiment.

While the process cartridge 3 is being pulled frontward, the projection 230 of the drum cartridge 14 may contact the restrictor surface 220 of the pin 210 in the blocking position.

Thus, the restrictor surface 220 of the pin 210 may restrict the process cartridge 3 from further frontward and place the process cartridge 3 in the second position.

According to the image forming apparatus 1 in the modified embodiment, the benefits achievable by the image forming apparatus 1 in the fourth embodiment may be achieved likewise.

12. More Examples

Although examples of carrying out the present disclosure have been described, those skilled in the art may recognize that there are numerous variations and permutations of the image forming apparatus that fall within the spirit and scope of the invention as set forth in the appended claims. It may be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

For example, the switching member 41 described in the first and second embodiments may not necessarily be provided as a part of the drum cartridge 14 but may be provided as a part of the toner cartridge 15.

For another example, the first engageable part 159 in the groove 156 in the second embodiment may not necessarily be in the concave form but may be formed in a convex form to project, and the second engageable part 182 in the toner cartridge 148 may not be formed to project in the convex form but may be in a concave form.

For another example, the process cartridge 3 may not necessarily be restricted from moving from the second position by the drum shaft 17B of the photosensitive drum 17 but may be restricted from moving from the second position by a projection, which may be formed in the drum frame 40 or the developer frame 62.

For another example, the second conveyer roller 49 may not necessarily be included in the drum cartridge 14 but may be attached to the main body 2.

For another example, the main body 2 may not necessarily have the grooves 96 to guide the process cartridge 3, but the process cartridge 3 may be guided in the grooves 95 alone.

For another example, the blade spring 190 to restrict the process cartridge 3 from moving from the second position described in the third embodiment may be replaced with a wire spring.

What is claimed is:

1. An image forming apparatus comprising:

a main body having an opening;

a process cartridge movable between an attached position, in which the process cartridge is entirely placed in an inner space formed inside the main body on an inner side with respect to the opening, and a detached position, in which the process cartridge is entirely placed outside the inner space on an outer side with respect to the opening, via an intermediate position, which is between the attached position and the detached position, the process cartridge comprising an operable portion; and a cover movable between a closing position, in which the cover closes the opening, and an open position, in which the opening is exposed externally to the main body, the cover comprising a supportive part for supporting the process cartridge when the process cartridge is at the intermediate position, wherein the main body comprises a cartridge guide for guiding the process cartridge when the process cartridge moves from the intermediate position to the attached position, and wherein, when the process cartridge is at the intermediate position, at least a part of the operable portion is placed outside the inner space, wherein the process cartridge comprises:

a drum cartridge comprising a photosensitive drum and a frame; and a toner cartridge attachable to and detachable from the frame, wherein the drum cartridge comprises a switching member configured to switch states in the process cartridge, while the toner cartridge is attached to the frame, between a first state, in which the toner cartridge is restricted from being detached from the frame, and a second state, in which the toner cartridge is released to be detachable from the frame, and wherein the operable portion is coupled to the switching member.

2. The image forming apparatus according to claim 1, wherein the toner cartridge comprises a first projection projecting along an axial direction of the photosensitive drum, wherein the switching member comprises:

a shaft extending in the axial direction; and a second projection extending in a first direction, the first direction being orthogonal to the axial direction, the second projection being engageable with the first projection, and wherein the operable portion extends from the shaft in a second direction being a different direction from the first direction.

3. The image forming apparatus according to claim 1, wherein the operable portion forms an operable lever, the operable lever being configured to move the switching member from a restrictive position, in which the switching member places the process cartridge in the first state, and a releasable position, in which the switching member places the process cartridge in the second state, by being operated by a user.

4. The image forming apparatus according to claim 3, wherein the operable lever is formed to have a plate-like shape arranged to spread in an axial direction of the photosensitive drum and in a direction orthogonal to the axial direction.

5. The image forming apparatus according to claim 1, wherein the toner cartridge comprises a developer roller.

6. An image forming apparatus comprising:

a main body having an opening;

a process cartridge movable between an attached position, in which the process cartridge is entirely placed in an inner space formed inside the main body on an inner side with respect to the opening, and a detached position, in which the process cartridge is entirely placed outside the inner space on an outer side with respect to the opening, via an intermediate position, which is between the attached position and the detached position; and a cover movable between a closing position, in which the cover closes the opening, and an open position, in which the opening is exposed externally to the main body, the cover comprising a supportive part for supporting the process cartridge when the process cartridge is at the intermediate position, wherein the main body comprises a cartridge guide for guiding the process cartridge when the process cartridge moves from the intermediate position to the attached position, and wherein the process cartridge comprises:

a drum cartridge comprising a photosensitive drum and a frame; and a toner cartridge attachable to and detachable from the frame, wherein the toner cartridge comprises a switching member configured to switch states in the process cartridge, while the toner cartridge is attached to the frame, between a first state, in which the toner cartridge is restricted from being detached from the frame, and a second state, in which the toner cartridge is released to be detachable from the frame.

7. The image forming apparatus according to claim 6, wherein the toner cartridge comprises a container cylinder, the container cylinder having a first toner-opening, wherein the switching member comprises an outer cylinder arranged on an outer circumference of the container cylinder, the outer cylinder having a second toner-opening, the outer cylinder being movable between a first cylinder position, in which the first toner-opening and the second toner-opening communicate, and a second cylinder position, in which the outer cylinder covers the first toner-opening, and wherein the outer cylinder is in the first cylinder position when the process cartridge is in the first state and in the second cylinder position when the process cartridge is in the second state.

8. The image forming apparatus according to claim 7, wherein the drum cartridge comprises a first engageable part recessed in an axial direction of the photosensitive drum, and wherein the toner cartridge comprises a second engageable part projecting from the outer cylinder in the axial direction, the second engageable part being engageable with the first engageable part when the process cartridge is in the first state.

9. The image forming apparatus according to claim 8, wherein the process cartridge comprises an operable portion, the operable portion being arranged on the outer cylinder of the switching member.

10. The image forming apparatus according to claim 8, wherein the process cartridge comprises an operable portion, at least a part of the operable portion being placed outside the inner space when the process cartridge is at the intermediate position.

11. The image forming apparatus according to claim 6, wherein the toner cartridge comprises a developer roller.

12. An image forming apparatus comprising:

a main body having an opening;

a process cartridge movable between an attached position, in which the process cartridge is entirely placed in an inner space formed inside the main body on an inner side with respect to the opening, and a detached position, in which the process cartridge is entirely placed outside the inner space on an outer side with respect to the opening, via an intermediate position, which is between the attached position and the detached position, the process cartridge comprising an operable portion; and a cover movable between a closing position, in which the cover closes the opening, and an open position, in which the opening is exposed externally to the main body, the cover comprising a supportive part for supporting the process cartridge when the process cartridge is at the intermediate position, wherein the main body comprises a cartridge guide for guiding the process cartridge when the process cartridge moves from the intermediate position to the attached position, and wherein, when the process cartridge is at the intermediate position, at least a part of the operable portion is placed outside the inner space, wherein the process cartridge comprises:

a drum cartridge comprising a photosensitive drum and a frame; and a toner cartridge attachable to and detachable from the frame, wherein the drum cartridge further comprises a switching member configured to switch states in the process cartridge, while the toner cartridge is attached to the frame, between a first state, in which the toner cartridge is restricted from being detached from the frame, and a second state, in which the toner cartridge is released to be detachable from the frame, and wherein the operable portion forms an operable lever, the operable lever being configured to move the switching member from a restrictive position, in which the switching member places the process cartridge in the first state, and a releasable position, in which the switching member places the process cartridge in the second state, by being operated by a user.

13. The image forming apparatus according to claim 12, wherein the operable lever is formed to have a plate-like shape arranged to spread in an axial direction of the photosensitive drum and in a direction orthogonal to the axial direction.

14. The image forming apparatus according to claim 12, wherein the toner cartridge comprises a developer roller.

* * * * *